US007182022B2

(12) United States Patent
Schneider et al.

(10) Patent No.: US 7,182,022 B2
(45) Date of Patent: Feb. 27, 2007

(54) DEVICE FOR STORING DRESSINGS HAVING VERTICALLY OFFSET AND SIDE-BY-SIDE ARRANGED LEVELS

(75) Inventors: Georg Schneider, Würzburg (DE); Karl Robert Schäfer, Rimpar (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 157 days.

(21) Appl. No.: 10/514,730

(22) PCT Filed: Feb. 19, 2004

(86) PCT No.: PCT/EP2004/050161

§ 371 (c)(1),
(2), (4) Date: Nov. 21, 2004

(87) PCT Pub. No.: WO2004/085160

PCT Pub. Date: Oct. 7, 2004

(65) Prior Publication Data

US 2005/0172846 A1 Aug. 11, 2005

(30) Foreign Application Priority Data

Mar. 28, 2003 (DE) ..... 103 14 344

(51) Int. Cl.
*B41L 47/14* (2006.01)
*B41F 27/12* (2006.01)

(52) U.S. Cl. ..... 101/477; 101/481; 101/480

(58) Field of Classification Search ..... 101/477, 101/481, 485, 486, 474, 479, 480; 414/796.2, 414/331.14, 331.16, 801, 810
See application file for complete search history.

(56) References Cited

U.S. PATENT DOCUMENTS

| | | | |
|---|---|---|---|
| 4,178,848 | A | 12/1979 | Ishii |
| 4,858,528 | A | 8/1989 | Inouye et al. |
| 5,111,744 | A | 5/1992 | Wieland |
| 5,127,328 | A | 7/1992 | Wieland |
| 5,526,747 | A | 6/1996 | Marmin et al. |
| 5,555,812 | A | 9/1996 | Ruckmann et al. |
| 5,623,877 | A | 4/1997 | Muth |
| 5,709,150 | A | 1/1998 | Durr et al. |
| 5,709,151 | A | 1/1998 | Durr et al. |
| 5,782,182 | A | 7/1998 | Ruckmann et al. |
| 6,393,986 | B1 | 5/2002 | Tobe et al. |
| 6,601,511 | B1 | 8/2003 | Tobe |

(Continued)

FOREIGN PATENT DOCUMENTS

| | | |
|---|---|---|
| DE | 39 40 795 A1 | 6/1991 |

(Continued)

*Primary Examiner*—Leslie J. Evanisko
(74) *Attorney, Agent, or Firm*—Jones Tullar & Cooper, PC

(57) ABSTRACT

A device is used to store blankets or dressings which are to be supplied to a cylinder of a printing machine. A plurality of such blankets or dressings, which are to be applied to the cylinder adjacent each other and axially spaced, are stored next to each other. These blankets or dressings are stored vertically above a supporting surface, in at least two vertically offset planes. The offset planes form a first storage position and the supporting surface forms a second storage position once at least one of the blankets or dressings has been stored in the different planes.

27 Claims, 33 Drawing Sheets

U.S. PATENT DOCUMENTS

| | | | | |
|---|---|---|---|---|
| 6,644,191 | B2 * | 11/2003 | Narui | 101/477 |
| 6,941,866 | B2 * | 9/2005 | Schneider et al. | 101/486 |

FOREIGN PATENT DOCUMENTS

| | | | |
|---|---|---|---|
| DE | 39 40 796 | A1 | 6/1991 |
| DE | 43 42 359 | C1 | 6/1995 |
| DE | 44 24 931 | C2 | 7/1995 |
| DE | 44 08 025 | A1 | 9/1995 |
| DE | 44 42 574 | C2 | 6/1996 |
| DE | 198 04 106 | A1 | 8/1999 |
| DE | 198 52 343 | A1 | 5/2000 |
| DE | 102 38 123 | A1 | 3/2004 |
| EP | 0 100 779 | A1 | 2/1984 |
| EP | 0 214 549 | B1 | 3/1987 |
| EP | 1 084 837 | A1 | 3/2001 |
| EP | 1 084 839 | A1 | 3/2001 |
| WO | WO 93/04863 | | 3/1993 |

* cited by examiner

DEVICE FOR STORING DRESSINGS HAVING VERTICALLY OFFSET AND SIDE-BY-SIDE ARRANGED LEVELS

CROSS-REFERENCE TO RELATED APPLICATIONS

This application is the U.S. National Phase, under 35 U.S.C. 371, of PCT/EP 2004/050161, filed on Feb. 19, 2004; published as WO 2004/085160 A1 on Oct. 7, 2004, and claiming priority to DE 103 14 344.0 filed Mar. 28, 2003, the disclosures of which are expressly incorporated herein by reference.

FIELD OF THE INVENTION

The present invention is directed to devices for storing a dressing to be supplied to a printing press. A plurality of dressings to be applied side-by-side to a cylinder of the printing press are stored side-by-side.

BACKGROUND OF THE INVENTION

A method and a device for making printing plates available is known from DE 44 42 574 C2. In a position of readiness, the printing plates are hung in two suspension rails, which rails extend parallel with respect to the cylinder and which are vertically offset in respect to each other. The rails are part of a printing plate readiness device and are pre-positioned. The printing plates hanging in the suspension rails are subsequently transported, by a pivot movement of the printing plate readiness device of approximately 90° around an axis parallel with the cylinder, into a standby position close to the cylinder. Printing plates, which are to be arranged side-by-side on the cylinder, in the axial direction of the latter, are arranged side-by-side on the same suspension rail. A space, which remains the same in width parallel with the cylinder, exists between the printing plates hung in the same axial position of the cylinder from the first and second suspension rails and which are to be arranged at different circumferential positions of the cylinder. Because of the intended pivot movement of the printing plate hanging at the vertically offset suspension rails, the printing plate readiness device requires a very large structural space which, however, is not always available in printing presses. The readiness position, which is remote from the cylinder, obstructs access to the printing group, which obstruction often causes problems in actual use, and is at least undesirable. Moreover, because of acceleration forces which act on the printing plate readiness device, during the pivot movement, the danger arises that individual printing plates may come loose from their suspension rail, or may, at least, slip in it and may thereby change their pre-positioning. This can negatively affect the dependability of the feed of the printing plates to the cylinder. The air resistance, which is generated because of the large surfaces of the printing plates, does not, by itself, permit a rapid pivot movement, if it is intended to prevent an interference with the progress of the printing plate readiness device caused by the slippage of the printing plates. Also, the construction of the printing plate readiness device is very expensive because of the many machine elements required.

A method and a device for the automatic feeding of a printing plate to a plate cylinder, or for the removal of a printing plate from a plate cylinder of a rotary printing press, are known from DE 39 40 795 A1. The method for the automatic feeding of a printing plate to a plate cylinder of a rotary printing press, wherein inter alia the plate cylinder has structure for clamping and for bracing the printing plate, provides that the printing plate is placed into a storage chamber of a printing plate supply and removal device, that the plate cylinder is rotated into a plate feeding position, and that the printing plate is fed to a clamping device of the plate cylinder by operation of a number of transport rollers. The method for the automatic removal of a printing plate from a plate cylinder of a rotary printing press, wherein the plate cylinder inter alia has structure for unclamping and for releasing the printing plate, is distinguished in that the plate cylinder is rotated forward into a printing plate release position, that a clamping flap is opened for grasping a printing plate end, that the plate cylinder is rotated backward, and that the printing plate is conveyed by a number of transport rollers to a storage chamber of a printing plate supply or removal device. The device for executing the above mentioned methods has at least one transport roller configured as a drive roller, and one transport roller configured as a contact pressure roller, and wherein the contact pressure roller can be placed against the drive roller. In addition, various actuating devices, a pivotably seated contact pressure roller for pressing the printing plate against the plate cylinder, as well as ejection fingers, can be provided. The ejection fingers can have tips which are arranged so that they can swivel into the periphery of the plate cylinder. The storage chamber of the printing plate supply and removal device can also be seated so that it is pivotable around a joint.

DE 39 40 796 A1 describes an arrangement for automatically changing a printing plate on a plate cylinder of a rotary printing press, The plate cylinder has, inter alia, devices for clamping and for bracing a printing plate. The printing plate changing device has two storage chambers, so that a printing plate, released from the plate cylinder, can be conducted into one of the storage chamber by the use of transport rollers, while a printing plate stored in the other storage chamber can be conducted to a clamping device of the plate cylinder also by use of transport rollers.

EP 1 084 839 A1 describes a device for holding and for conveying a printing forme. In this case, the device has translatory conveying arrangements, which convey a printing forme to be mounted on a forme cylinder, or which convey a printing forme to be removed from the plate cylinder. For changing a printing forme, the device is tilted around an axis of rotation from a position of rest into its operating position. A hook is pivoted, merely by its inherent weight, into the space where the printing forme is stored and protects the printing forme at its trailing beveled end from unintentionally falling out of this space.

A device for the automatic feeding of a printing plate to a forme cylinder of a printing press, or for removing a printing plate from a forme cylinder, is known from EP 0 214 549 B1. The printing plate to be fed to the forme cylinder is fed to the forme cylinder while remaining in a desired position by the use of lateral positioning elements. The feeding of the printing plate takes place from a substantially horizontal storage position.

A device for automatically exchanging printing plates is known from EP 0 100 779 A1. Several plates to be mounted are suspended in a plate storage device on a clamping rod which is arranged below the plate cylinder and are lifted to the plate cylinder on the clamping rod.

A device for automatically changing printing plates is known from WO 03/04863 A1. Several printing formes are stored in a magazine, and a changing of a printing forme with a forme cylinder takes place only when the magazine is brought into a slanted position.

A device for the automatic feeding of printing formes to a forme cylinder is known from U.S. Pat. No. 4,178,848. Printing formes without beveled ends are stored in a stack inclined in the feeding direction, and are sequentially fed, driven by rollers, to the forme cylinder via a conveyor belt arranged in front of the stack. The lowest printing forme is pulled from the stack, at its front end, by a suction device. This device, which is very long, is not suitable for printing formes with beveled ends. Furthermore, when pulling out the printing formes which are stacked directly on top of each other, there is the danger of damaging their sides which are provided with the print image.

SUMMARY OF THE INVENTION

The object of the present invention is directed to providing a device for storing a dressing to be supplied to a cylinder of a printing press.

This object is attained in accordance with the invention by the provision of a device for storing a plurality of dressings that are to be applied, in a side-by-side orientation to a cylinder in its axial direction. The dressings are stored in the device side-by-side. The dressings may be stored on at least two levels which are arranged side-by-side and may be vertically offset from each other. Prior to their being fed to the cylinder, the dressings may be stored in a second storage position side-by-side on a single level which extends in the axial direction of the cylinder.

The advantage which can be realized by the present invention consists, in particular, in that it is possible to change several dressings on a cylinder of a printing press rapidly and dependably at the same time, or at least in very rapid succession. By the actuation of a holding element, the dressing falls from a vertically upper storage position into a storage position located thereunder, from which lower storage position the dressing can be transported to the cylinder. By actuating the holding element, the stored dressing changes in free fall from its vertically upper storage position into the storage position located underneath. The actuation of the holding element preferably takes place by use of a controlled drive mechanism and can therefore be mechanically performed. In the course of changing the storage position of a dressing stored in the magazine, the dressing, whose storage position is to be changed, remains in the magazine during the changing operation, wherein the change can be triggered by a controllable machine element of the magazine.

A dressing, whose storage position is to be changed, is not exposed to the danger of its surface being damaged during the change. The device in accordance with the present invention is also particularly suitable for dressings which are flexionally elastic, in length, and which have suspension legs that are beveled at their ends. Moreover, the structural height of the device is extremely low, so that it does not hamper any required access to the printing unit.

BRIEF DESCRIPTION OF THE DRAWINGS

Preferred embodiments of the present invention are represented in the drawings and will be described in greater detail in what follows.

Shown are in:

FIG. 1, a perspective representation of a dressing, in

DESCRIPTION OF THE PREFERRED EMBODIMENTS

Figure 1:
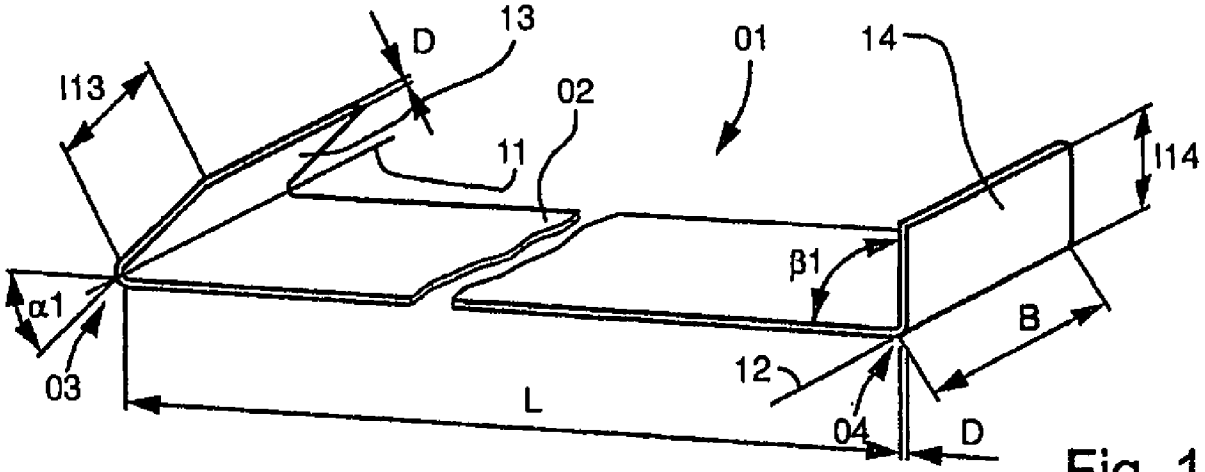
Figure 2:
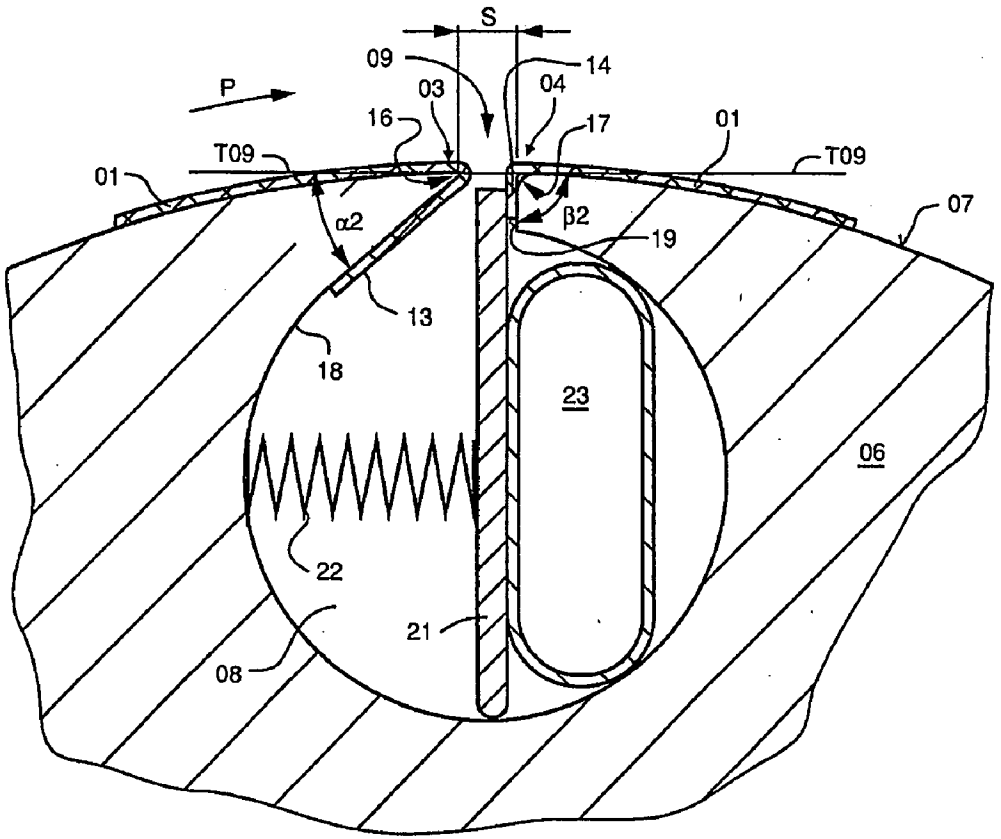
FIG. 2, a simplified cross-sectional representation of a holding device for a dressing arranged on a cylinder, in FIG. 3, dressings which have been brought tangentially to a cylinder, and on which a radial force acts during their mounting, in FIG. 4, elastically pre-tensioned dressings in the course of being mounted on a cylinder, in FIG. 5, a four-cylinder printing press with a printing forme magazine, in FIG. 6, a device for changing a dressing on a forme cylinder of a printing press, in FIG. 7, a detailed view of guide rails for the lateral holding of a second printing forme in a chute, in FIG. 8, printing formes arranged next to each other in the axial direction of the forme cylinder in a chute, in FIG. 9, a suspension of a guide rail which can be moved in a chute, in FIGS. 10 to 12, further embodiments of the embodiment of the lower chute, in FIGS. 13 to 35, representations of a process sequence for changing printing formes on a forme cylinder, and in FIG. 36, a further preferred embodiment of a printing press with printing forme magazines.

A dressing 01, as seen in FIG. 1, which, for example, is configured as a plate-shaped printing forme 01, or as a support plate for a printing blanket, has a substantially rectangular area of a length L and a width B. The length L can have measured values between 400 mm and 1300 mm, for example, and the width B can have measured values between 280 mm and 1500 mm, for example. Preferred measured values for the length L lie, for example, between 360 mm and 600 mm, and preferred values for the width B lie, for example between 250 mm and 430 mm. The rectangular area has a bearing area, which will be called bearing area 02 in what follows, on which bearing area 02 the dressing 01 rests when it is arranged on the surface 07 of a cylinder 06, as seen in FIG. 2. The reverse side of the bearing area 02 is a working area which, in case the dressing 01 is configured as a printing forme 01, is provided with a print image, or at least can be provided with a print image. The dressing 01 has two oppositely located ends 03, 04, each of which is preferably provided with beveled suspension legs 13, 14 these ends 03, 04 delimit the bearing area 02, and each of the suspension legs 13, 14 preferably extends wholly, or at least partially, over the width B of the dressing 01. The bearing area 02 of the dressing 01 is flexible, at least over the length L, and, when the dressing 01 is arranged on the surface 07 of the cylinder 06, bearing area 02 can be matched to the curvature of the latter as seen in FIG. 2. When the printing forme 01 is arranged on the cylinder surface 07, the length L of the bearing area 2 then extends in the direction of the circumference of the cylinder 06, while the width B of the bearing area 02 extends in the axial direction of the cylinder 06.

As represented in FIG. 2, the suspension legs 13, 14 of the dressing 01 are fastened, by the use of a holding device. The holding device is arranged in a groove 08. The groove 08, as a rule, extends in the axial direction with respect to the cylinder 06. An end 03 of the dressing 01, which is aligned with the production direction P of the cylinder 06, is called its leading end 03, while the oppositely located end 04 is the trailing end 04 of the dressing 01. At least the ends 03, 04 of the dressing 01, along with suspension legs 13, 14, which are formed thereon, are made of a rigid material, for example of a rigid metallic material, such as, for example, an aluminum alloy. Customarily, the material thickness D of the dressing 01, as shown in FIG. 1, or the material thickness D of at least the suspension legs 13, 14, amounts to a few tenths of a millimeter, for example 0.2 mm to 0.4 mm, and preferably to 0.3 mm. Thus, the dressing 01 as a whole, or at least its ends 03, 04, consists of a dimensionally stable material, so that the ends 03, 04 can be permanently deformed by bending against a material-specific resistance.

A beveled suspension leg 13, 14 is, as discussed above formed at least on one end 03, 04 of the dressing shown in FIG. 1, but preferably are formed at both ends 03, 04, along a bending edge 11, 12. The suspension legs 13, 14 can be introduced into a narrow, and in particular, into a slit-shaped opening 09 of the groove 08 of the cylinder 06 as shown in FIG. 2, and can be fastened there by a holding device, for example by a clamping device. For example, in relation to the length L of the non-curved level bearing area 02 of the not yet mounted dressing 01, a suspension leg 13 is beveled on its leading end 03, at the bending edge 11, at an opening angle $\alpha 1$ or, on its trailing end 04, a suspension leg 14 is beveled at the bending trailing edge 12 at an opening angle $\beta 1$, as seen in FIG. 1, wherein the opening angles $\alpha 1$, $\beta 1$, as a rule, lie between 30° and 140°. If the opening angle $\alpha 1$ is assigned to the leading end 03 of the dressing 01, it is preferably embodied as an acute angle and, in particular, is 45°. The opening angle $\beta 1$, at the trailing end 04 of the dressing 01, is often embodied to be larger than 80°, or as an obtuse angle, and, in particular, it is 85° or 135°. The beveled suspension leg 13 at the leading end 03 has a length l13 which, for example, lies in the range of between 4 mm to 30 mm, and in particular lies between 4 mm and 15 mm. The beveled suspension leg 14 at the trailing end 04 of the dressing 01 has a length l14 which is 4 mm to 30 mm, for example, and in particular which is between 8 mm and 12 mm. The shorter length is more likely preferred in order to assure the easiest possible removal of the suspension legs 13, 14 from the opening 09 of the groove 08.

FIG. 2 shows, in a simplified cross-sectional view, a cylinder 06 with a surface 07 and with a groove 08, which has a narrow, slit-like opening 09 directed toward the surface 07 and of a slit width S. The slit width S is less than 5 mm and preferably lies in the range between 1 mm to 3 mm. In the production direction P of the cylinder 06, the opening 09 has a front edge 16 and a rear edge 17. An acute opening angle $\alpha 2$, which lies between 30° and 50°, and which preferably is 45°, is formed between a wall 18 extending from the front edge 16 in the direction of the groove 08, and an imagined tangent line T09, which rests on the opening 09 in the surface 07 of the cylinder 06. Therefore, the beveled suspension leg 13, at the leading end 03 of the dressing 01, can be preferably suspended with a positive connection at this front edge 16 of the opening 09, because the opening angle $\alpha 1$ at the leading end 03 of the dressing 01 is preferably matched to the opening angle $\alpha 2$. The situation is the same at the trailing end 04 of the dressing 01. An opening angle $\beta 2$, which either lies between 80° and 95°, and is preferably 90°, or which lies between 120° and 150°, and which preferably is 135°, is formed between a wall 19 extending from the rear edge 17 in the direction of the groove 08 and an imagined tangent line T09, which rests on the opening 09 in the surface 07 of the cylinder 06. Therefore, the beveled suspension leg 14 at the trailing end 04 of the dressing 01 can be preferably suspended with a positive connection, at this rear edge 17 of the opening 09, because the opening angle $\beta 1$ at the trailing end 04 of the dressing 01 is preferably matched to the opening angle $\beta 2$ at the groove rear edge wall 19.

At least one, preferably pivotably seated, holding element 21, and a, preferably pre-tensioned, spring element 22, for example, are arranged in the groove 08. The spring element 22 presses the holding element 21 against the beveled suspension leg 14 at the trailing end 04, for example, which suspended leg 14 is suspended from the rear edge 17 of the opening 09, because of which pressure force, the suspension leg 14 is maintained at the trailing end 04 against the wall 19 extending from the rear edge 17 in the direction of the groove 08. For use in releasing the pressure force exerted by the holding means 21, an actuating element 23, preferably a pneumatically actuable element 23, is provided in the groove 08, which actuating element 23, when actuated, pivots the holding element 21 against the force of the spring element 22. The holding device described by way of example therefore consists substantially of the holding element 21, the spring element 22 and the actuating element 23.

The cylinder 06 described above, by way of example, is preferably embodied in such a way that several, preferably identical dressings 01 can be arranged on its surface 07. If the cylinder 06 is designed as a forme cylinder, it can be covered, for example, with six plate-shaped printing formes 01, which are arranged side-by-side in its axial direction. More than one dressing 01 can be arranged on the cylinder 06, in the direction of its circumference. It is therefore possible to provide, for example, two grooves 08, each extending axially in respect to the cylinder 06, under its surface 07, which each have openings 09 extending axially in respect to the cylinder 06 for fastening dressings 01. The openings 09 are arranged on the circumference of the cylinder 06, for example offset by 180° with respect to each other, if two dressing 01 are to be arranged behind each other along its circumference. With this covering of the cylinder 06 with two dressings 01 arranged behind each other, the leading end 03 of the one dressing 01 is fastened in the one groove 08, while the trailing end 04 of the same dressing 01 is fastened in the other groove 08. This applies correspondingly to the one or to the remaining dressings 01 arranged on this cylinder 06. If several dressings 01 are arranged side-by-side in the axial direction of the cylinder 06, these can advantageously also be arranged offset with respect to each other. The offset can involve, for example, individual dressings 01, or can involve groups of dressings 01, each of which is arranged offset, for example by half of the length L of the dressing 01 which, offset however, requires that further grooves 08 with associated openings 09, or at least that partial elements of the same, are cut into the cylinder 06, which openings are arranged along the circumference of the cylinder 06 offset by 90°, for example, in relation to the previously mentioned grooves 08 and openings 09.

Figure 3:
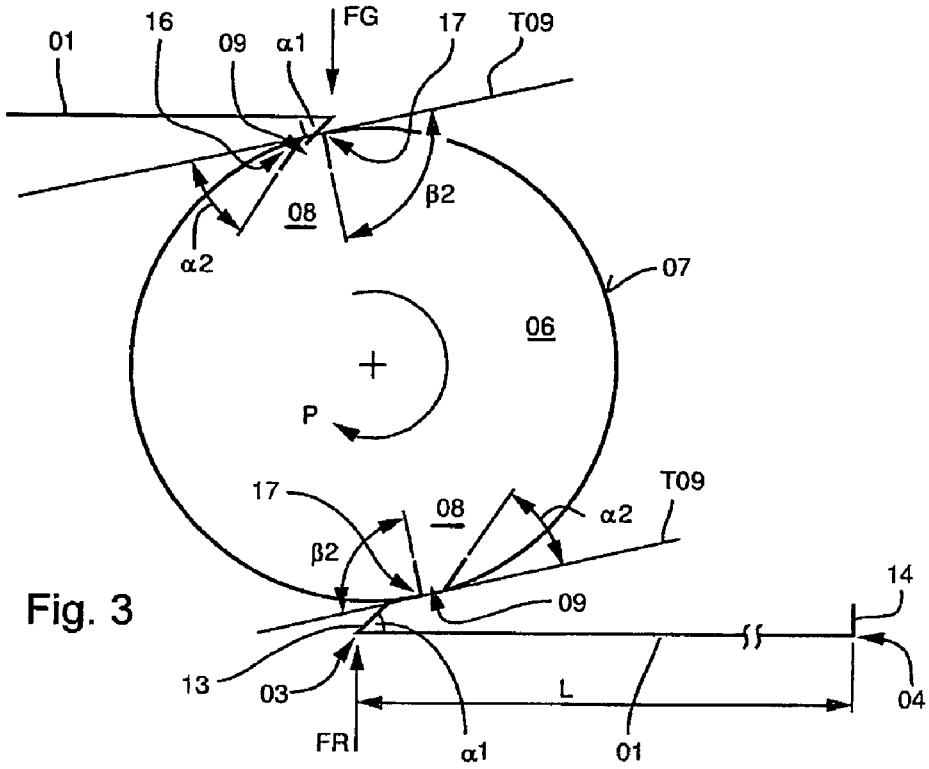

The method for mounting of a flexible dressing 01 on a cylinder 06 of a printing press will be described, by way of example, in what follows, wherein two dressings 01 can be arranged one behind the other along the circumference of the cylinder 06, and wherein each dressing 01 has, related to the production direction P of the cylinder 06, a leading end 03 and a trailing end 04 as shown schematically in FIG. 3. A suspension leg 13 is formed at the leading end 03 of the dressing 01, and wherein this leading end suspension leg 13 is beveled at an opening angle $\alpha 1$ of maximally 90°, and preferably of 45°, with respect to the linear length L of the dressing 01. At least one, preferably slit-shaped opening 09 with, viewed in the production direction P of the cylinder 01, a first leading edge 16 and a second, trailing edge 17, is provided in the cylinder 06. The edges 16, 17 preferably extend parallel, in respect to each other, in the axial direction of the cylinder 06. The leading end 03 of the dressing 01 is brought to the cylinder 06, preferably tangentially with respect to the cylinder's production direction P, for example by the use of a thrusting force acting on the trailing end 04 of the dressing 01, the suspension leg 13 at the leading end 03 of dressing 01 is thus located behind the second edge 17 of the opening 09 on the cylinder 06, so that, in the course of a rotation of the cylinder 06 in its production direction P, the suspension leg 13, formed on the leading end 03 of dressing 01 engages the opening 09 as a result of a radial force FR, which acts at least on the leading end 03 and which force FR is directed toward the cylinder 06. Suspension leg 13 is thus hooked on the first edge 16. In the case where the dressing 01 rests, supported by its suspension leg 13 formed on its leading end 03, on the surface 07 of the cylinder 06, the radial force FR can be, for example, the gravitational force FG of the dressing acting on the surface 07 of the cylinder 06.

Figure 4:
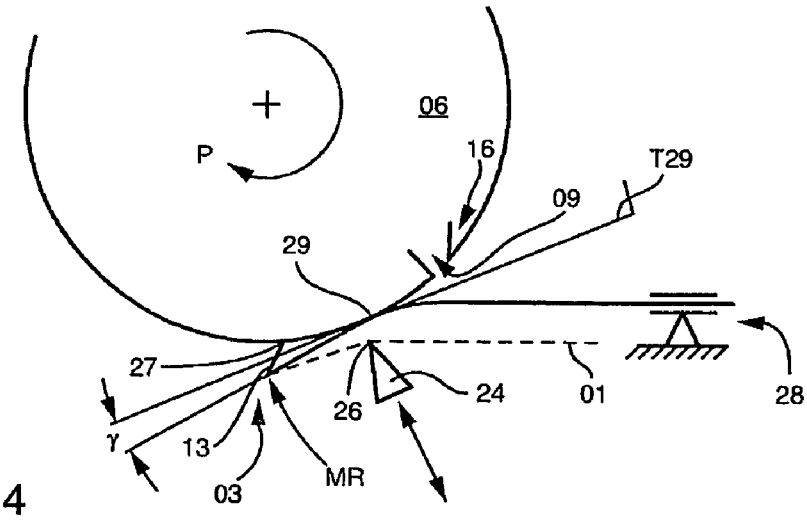

In addition to using the gravitational force FG of the dressing 01, or alternatively thereto, the leading end 03 of the dressing 01 can be elastically pre-stressed, as depicted in FIG. 4, so that the suspension leg 13 formed on the leading end 03 springs into the opening 09 as a result of a restoring moment MR directed to the cylinder 06 as soon as the opening 09 of the cylinder 06, and a contact line 27 of the suspension leg 13 with the surface 07 of the cylinder 06, are located directly opposite each other because of a relative movement between the dressing 01 and the cylinder 06. This relative movement occurs, in particular, because of the rotation of the cylinder 06 in the production direction P.

The restoring moment MR results because the dressing 01 is made of an elastically deformable material and therefore inherently has an elastically resilient property. This property is used in such a way that, in the course of being brought to the cylinder 06, the leading end 03 of the dressing 01 is conducted, for example, over an edge 26, which preferably extends axially in respect to the cylinder 06 and which edge 26 is arranged, spaced apart from the cylinder 06, on a support element 24. Dressing 01 is bent at edge 26 in such a way that a bending stress with a spring force, as seen in the representation of the dressing 01 in dashed lines in FIG. 4, which is directed toward the cylinder 06, is built up at the leading edge 03 of the dressing 01. At least until the leading end 03 of the dressing 01, which is conducted over the edge 26 of the support element 24, rests on the surface 07 of the cylinder 06, the trailing end 04 of dressing 01 is fed in from a spatial direction, which is fixed, toward the cylinder 06. Accordingly, the dressing 01 is stabilized during the mounting process by the contact line 27 of its suspension leg 13, attached to the leading end 03, with the surface 07 of the cylinder 06, as well as by its support on the edge 26 of the support element 24, and is also stabilized by a positional fixation device 28 of the trailing end 04. The support element 24 can be embodied, for example, as a roller element 24, in particular as a roller 24, or as one, or as several rollers 24, which are arranged axially side-by-side, with respect to the cylinder 06, which can be placed against the cylinder 06, for example, and which function in the manner of a contact pressure element 24. The support element 24 is preferably arranged close to the cylinder 06.

The leading end 03 of the dressing 01 can also be brought against the cylinder 06 in such a way that, following its contact with the surface 07 of the cylinder 06, this leading end 03 faces away from the surface 07 of the cylinder 06 at an acute angle γ of an imagined second tangent line T29, which rests on a contact point 29 on the surface 07 of the cylinder 06 and shown as a representation of the dressing 01 in solid lines in FIG. 4. However, the bending of the leading end 03 of the dressing 01 should only be so large that the suspension leg 13 arranged there still rests dependably against the surface 07 of the cylinder 06. To assist the dependable resting of the suspension leg 13 against the surface 07 of the cylinder 06, it is possible, for example, to bring the support element 24 into contact with the dressing 01, so that the leading end 03 of the dressing 01 is maintained close to the surface 07 of the cylinder 06.

In the course of relative movement between the cylinder 06 and the dressing 01, preferably in the course of the rotation of the cylinder 06 in its production direction P, but also in the course of a suitable movement of the dressing 01 as well, for example movement of the dressing 01 counter to the production direction P of the cylinder 06, the suspension leg 13 is hooked at the first edge 16 of the opening 09 on the leading end 03 of the dressing 01. A roller element 24, which may be the support element 24 and which is placed against the cylinder 06, can then aid the mounting of the dressing 01 on the cylinder 06 since the roller element 24 rolls the dressing 01 up on the cylinder 06. The suspension leg 14 is embodied on the trailing end 04 of the dressing 01 wherein, in the course of rolling the dressing 01 up on the cylinder 06, this trailing suspension leg 04 is pushed into the opening 09 of the cylinder 06 by the roller element 24.

Figure 5:
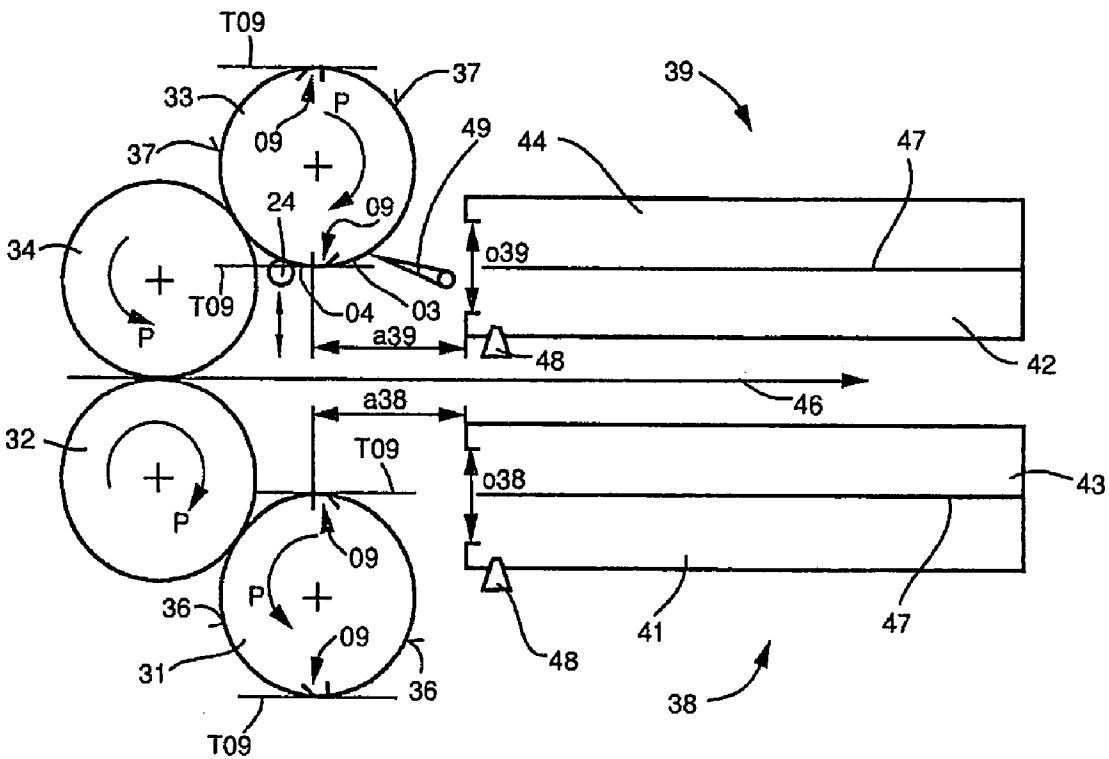

A device for executing the above described method will now be explained by the utilization of the example of a web-fed offset printing press with, for example, a vertical rubber-against-rubber printing group of four-cylinder construction and with, for example, the horizontal guidance of a material 46 to be imprinted, and preferably a paper web 46, as seen in FIG. 5. In this example, a first pair of cylinders 31, 32, which roll off on each other and which are arranged underneath the paper web 46 consist of a forme cylinder 31 and a rubber blanket cylinder 32. A second pair of cylinders 33, 34, which roll off on each other and which are arranged above the paper web 46 consist of a forme cylinder 33 and a rubber blanket cylinder 34. The two cylinder pairs are provided in the printing group, and the paper web 46 is conducted between the two rubber blanket cylinders 32, 34, which have been placed against each other. Preferably several, and, for example, five or six print locations for different colored ink are provided in the printing press. In what follows, it is assumed, for the sake of simplicity and without limiting the invention, that at least the forme cylinders 31, 33 are identical in type and in their dimensions.

The forme cylinder 31 is covered, about its circumference, with two printing formes 36, and the forme cylinder 33 is covered, or at least can be covered, in the same way with two printing formes 37, wherein the printing formes 36, 37 each have a length L corresponding, for example, to half the circumference of the forme cylinders 31, 33. The width of the printing formes 36, 37 depends, inter alia, on how many printing formes 36, 37 are to be arranged in the axial direction of the respective forme cylinders 31, 33. Thus, up to six printing formes 36, 37, for example, can be arranged side-by-side in the axial direction of the respective forme cylinder 31, 33. The forme cylinders 31, 33 are preferably embodied to be of double width and double circumference, while, for example, printing blankets, which are arranged on the rubber blanket cylinders 32, 34, are supported over the entire circumference of the rubber blanket cylinders 32, 34.

As already discussed, and as depicted in FIGS. 1 and 2, the printing formes 36, 37 each have beveled suspension legs 13, 14 on their front and rear ends, respectively in respect to the length L, with which suspension legs 13, 14 the printing formes 36, 37 are fastened to the respective forme cylinders 31, 33 because the suspension legs 13, 14 are introduced into one of the slit-shaped openings 09, which openings 09 have been cut into the surface of the forme cylinders 31, 33 and which extend in the axial direction in relation to the forme cylinders 31, 33. These beveled suspension legs 13, 14 are possibly held in openings 09 by a holding device arranged in the forme cylinder 31, 33, preferably in a groove 08. The opening angle $\alpha 1$ between the beveled suspension leg 13 at the leading end 03 of each printing forme 36, 37 and the linear length L of the printing forme 36, 37 is preferably 45°. At the trailing end 04 of each printing forme 36, 37, the opening angle $\beta 1$ between the beveled suspension leg 14 and the linear length L of the printing forme 36, 37 is preferably 90°. The slit width S of the openings 09 cut into the forme cylinders 31, 33 preferably is from 1 mm to 5 mm, and in particular is 3 mm.

For changing one or several of the printing formes 36, 37 placed on the forme cylinders 31, 33, a first printing forme magazine 38, which is arranged underneath the paper web 46, is, for example, provided for the forme cylinder 31, and a second printing forme magazine 39 is provided for the forme cylinder 33 and which is arranged above the paper web 46. Each such printing forme magazine 38, 39 has a receiving arrangement 41, 42, for example a chute 41, 42, for receiving at least one used printing forme 36, 37 to be removed from the respective forme cylinder 31, 33, and also has a receiving arrangement 43, 44, for example a chute 43, 44, for receiving a fresh printing forme 36, 37 to be mounted on the respective forme cylinder 31, 33. Each such receiving arrangement 41, 42, 43, 44 or chute preferably has several storing or storage positions, respectively for used printing formes 36, 37 to be removed and also has several storage positions for fresh printing formes 36, 37 to be mounted. While the printing forme magazine 38, 39, which is assigned to the respective forme cylinder 31, 33, for example, is placed, for example, against its respective forme cylinder 31, 33 for changing a printing forme 36, 37, the first forme cylinder 31 and the second forme cylinder 32, for example, are moved out of contact with their respective rubber blanket cylinder 32, 34 with which they are operatively connected. Alternatively, or additionally to the out-of-contact forme cylinders 31, 33, the rubber blanket cylinders 32, 34 can also be taken out of contact with the paper web 46. In this way, the respective forme cylinder 31, 33 is uncoupled from the paper web 46 during the change of one or of several printing formes 36, 37, while the other pair of cylinders 32, 34 can remain in production in the printing group.

The chutes 41, 43, or 42, 44, for receiving at least one used or one fresh printing forme 36, 37 are advantageously arranged in the respective first or second printing forme magazines 38, 39 substantially parallel with each other. They are preferably arranged on top of each other in a layered construction. In this case a separating wall 47, for example, in each of the respective printing forme magazines 38, 39 can separate the chutes 41 and 43, or 42 and 44, from each other, as may be seen in FIG. 5. Each of the chutes 41, 43, or 42, 44, has at least two storage positions for the printing formes 36, 37 to be stored in them. In order to make easy access to chutes 41, 43, or 42, 44 possible, even when the paper web 46 is running, such access being needed, for example, for removing a used printing forme 36, 37 from the chutes 41, 42, or for making a fresh printing forme 36, 37 available in the chutes 43, 44, these chutes 41, 43, or 42, 44, are accessible from a side of each chute which is facing away from the forme cylinder 33, or from a side of each one of the printing forme magazines 38, 39 which side extends parallel with the running direction of the paper web 46. Each of the printing forme magazines 38, 39 preferably extends over the width of the barrels of the forme cylinders 31, 33, but, extends at least over the width B of the printing forme 36, 37, and these magazines 38, 39 are capable of receiving a printing forme 36, 37, preferably completely, i.e. in accordance with their length L, in their respective chutes 41, 43, or 42, 44. The chutes 41, 43, or 42, 44, are placed into the magazines 38, 39, for example, wherein each magazine 38, 39 has an opening o38, o39, and wherein each of the openings o38, o39 can be aligned parallel with the barrel of the respective forme cylinder 31, 33. A printing forme 36, 37 can be fed via the respective openings o38, o39 to the respective forme cylinder 31, 33, or can be introduced from the respective forme cylinder 31, 33 into the chute 41, 43. For this purpose, the openings o38, o39 of the printing forme magazines 38, 39 are moved toward the forme cylinders 31, 33 at a clearly reduced distance a38, a39 in relation to an opening 09 in the forme cylinders 31, 33, which distance a38, a39 is less than the length L of the printing forms 36, 37. Advantageously, the distances a38, a39 have between minimally 2% and maximally 50% of the length L of the printing formes 36, 37. In particular, short distances a38, a39 of up to 10% of the length L are preferred. It is advantageous to arrange at least the printing forme magazine 39, which is arranged above the paper web 46, to be movable, so that this printing forme magazine 39 can be brought into or can be pivoted into a working position against the forme cylinder 33 from a position of rest which is arranged preferably above the printing group. An improved accessibility to the printing group results from this movable arrangement of the printing forme magazines 38, 39. This improved accessibility is beneficial, for example, for performing work required by the printing group, for example maintenance work. Preferably, in both the working position and the storage position, of the printing forme magazines 38, 39, but in at least the storage positions of the printing formes 36, 37, the chutes 41, 43, or 42, 44 are preferably arranged to be horizontal, or with a slight inclination, preferably of less than 15° in relation to the horizontal line H. The openings o38, o39 of the printing forme magazines 38, 39 preferably point towards one of the openings 09 in the respective forme cylinder 31, 33, with which the respective printing forme magazine 38, 39 works.

A movably arranged printing forme magazine 38, 39 can be fixed in place in its work position in front of a forme cylinder 31, 33 at a distance a38, a39 and in alignment with the forme cylinder 31, 33, by the use of an arresting device or stop 48 as seen in FIG. 5. The arresting device or stop 48 can be formed, for example, by a conical bolt which is fixed in place, for example in respect to the forme cylinder 31, 33, which bolt 48 engages an opening in the housing of the printing forme magazine 38, 39, and which centers the openings a38, a39 of a printing forme magazine 38, 39, for example pivoted against the forme cylinder 31, 33, with respect to the barrel of the forme cylinder 31, 33. It is advantageous to bring each forme cylinder 31, 33 into a predetermined position, in accordance with the side register, and to zero it in, for example with respect to the side register, before an exchange of a printing forme 36, 37 takes place between the forme cylinder 31, 33 and the printing forme magazine 38, 39. As an alternative to the setting of the forme cylinder 31, 33, the printing forme magazine 38, 39 can also be brought into a predetermined lateral position, in relation to the forme cylinder 31, 33, so that a correctly aimed exchange of a printing forme 36, 37 between the printing forme magazine 38, 39 and the forme cylinder 31, 33 can take place without lateral offset.

It is advantageous to arrange a hingedly seated, preferably pivotable guide plate 49, as shown in FIG. 5, near the forme cylinder 33 and in front of the opening of the printing forme magazine 39, which guide plate 49 can be directed toward the forme cylinder 33, and by the use of which guide plate 49, a trailing end 04 of a printing forme 37, which has been released from an opening 09 in the forme cylinder 33, is conducted, correctly aimed, to the chute 42 which is used for receiving the printing forme 37 to be removed. In particular, an erroneous access of a printing forme 37 to be removed from the forme cylinder 33, to the chute 44, in which at least one fresh printing forme 37 is made available, or in which such a fresh forme 37 can be made available, is blocked by the guide plate 49. The application of a guide plate 49 at the printing forme magazine 38 which is arranged underneath the paper web 46, and which works together with the forme cylinder 31, can also be advantageous. For reasons of clarity such a lower guide plate 49 is not specifically represented in FIG. 5.

Figure 36:
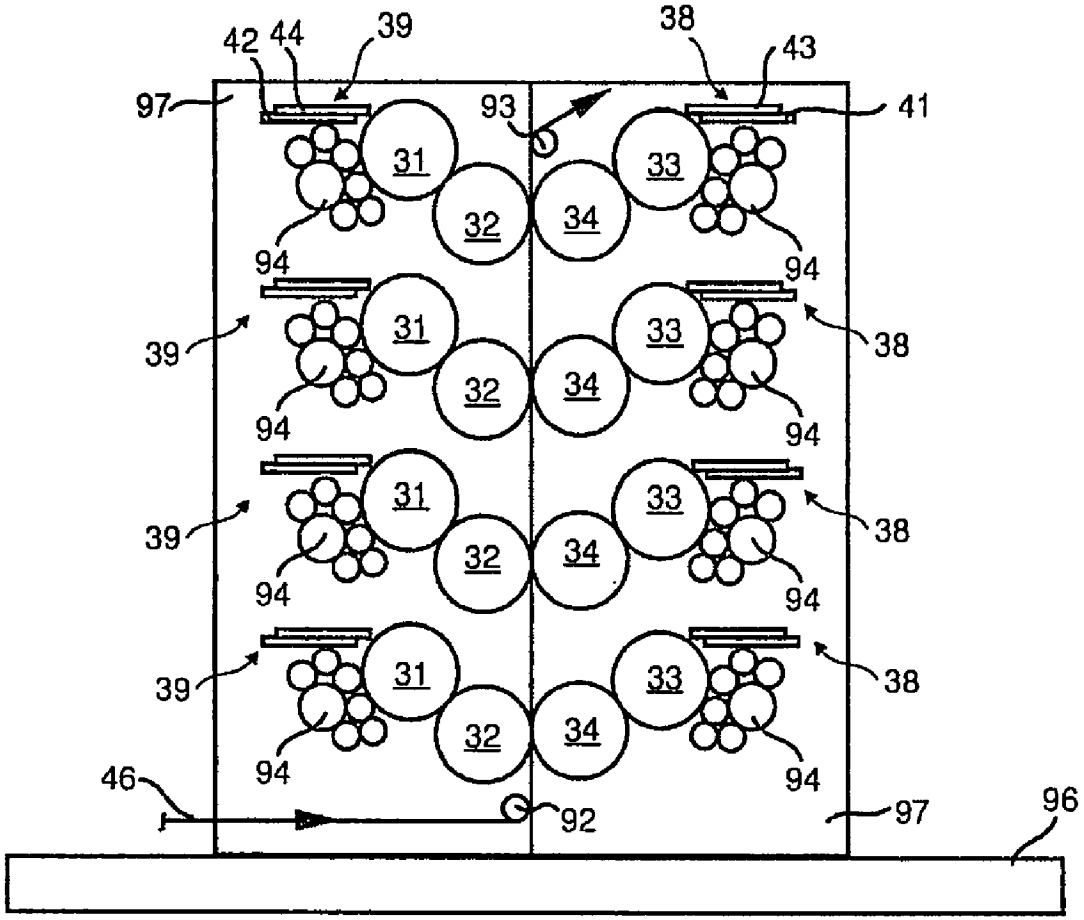

A further preferred embodiment of a printing press with printing forme magazines results in connection with a printing press, for example in connection with a multi-color offset printing press, whose printing groups are preferably arranged on top of each other in a bridge construction, or in a compact figure-eight construction, in at least one frame 97 on a base 96, i.e. a printing press of low structural height with eight print positions, such as is shown, by way of example, in FIG. 36. The material 46 to be imprinted, preferably a paper web 46, is fed to the printing press and is conducted vertically through the printing groups. Four printing groups, which are arranged above each other, in the transport direction of the paper web 46, are represented, by way of example, in FIG. 36, which printing groups each have respectively a transfer cylinder 32, 34 with a forme cylinder 31, 33 to the right and to the left of the paper web 46, and wherein the transfer cylinders 32, 34, which are oppositely located at the paper web 46 in a printing group, roll off on each other. The paper web 46 is brought to the first printing group, for example by a first paper guide roller 92 that is arranged ahead of the first printing group, and the paper web 46 conducted away from the fourth printing group by a second paper guide roller 93 that is arranged downstream of the fourth printing group. At least one conventional inking system 94, whose details will not be discussed here in detail, is assigned to each forme cylinder 31, 33. A printing forme magazine 38, 39 is assigned to each forme cylinder 31, 33, each of which magazines preferably has two chutes 41, 42, 43, 44. In the same way as was discussed in connection with the preferred embodiment described above in connection with FIG. 5, in the working position, each printing forme magazine 38, 39, at least its storage position for a printing forme 36, 37 to be stored, is here also aligned, preferably substantially horizontally, or with only a slight inclination of less the 15°, with respect to the forme cylinder 31, 33. In the working position of the printing forme magazine 38, 39, at least one printing forme 36, 37 can be exchanged between the chutes 41, 42, 43, 44 and the forme cylinder 31, 33. Either a printing forme 36, 37, which is no longer needed for executing a printing job, is removed from the forme cylinder 31, 33 and is inserted into the chute 41, 42, or a fresh printing forme 36, 37 is taken out of the chute 43, 44 and is mounted on the cylinder 31, 33 for executing the printing job. In this preferred embodiment, the structural characteristics of the printing forme magazines 38, 39 can correspond to those in the preferred embodiment previously described in connection with FIG. 5. It is advantageous if the operation, and in particular if the execution of a printing forme change, is monitored by sensors. Simultaneously, the printing forme magazines 38, 39, together with the forme cylinders 31, 33, can be controlled in such a way that a printing forme change can be selectively initiated, preferably from a control console that is assigned to the printing press. Because the printing forme magazines 38, 39 can be prepared for a printing forme change during the running production of the printing press, a set-up time, requiring a downtime of the printing press for a printing forme change, is reduced to an extremely short period of time of, for example, less than two minutes, and preferably of less than ninety seconds, for a complete change of all of the printing formes 36, 37 of the printing groups arranged in this printing press. Depending on the configuration of the printing groups, ninety-six printing formes 36, 37 can be simultaneously employed in the described printing press, for example. Such a rapid printing forme change, even with an increased number of printing formes 36, 37, considerably increases the efficiency of the printing press because of the resulting extremely short downtime.

Figure 6:
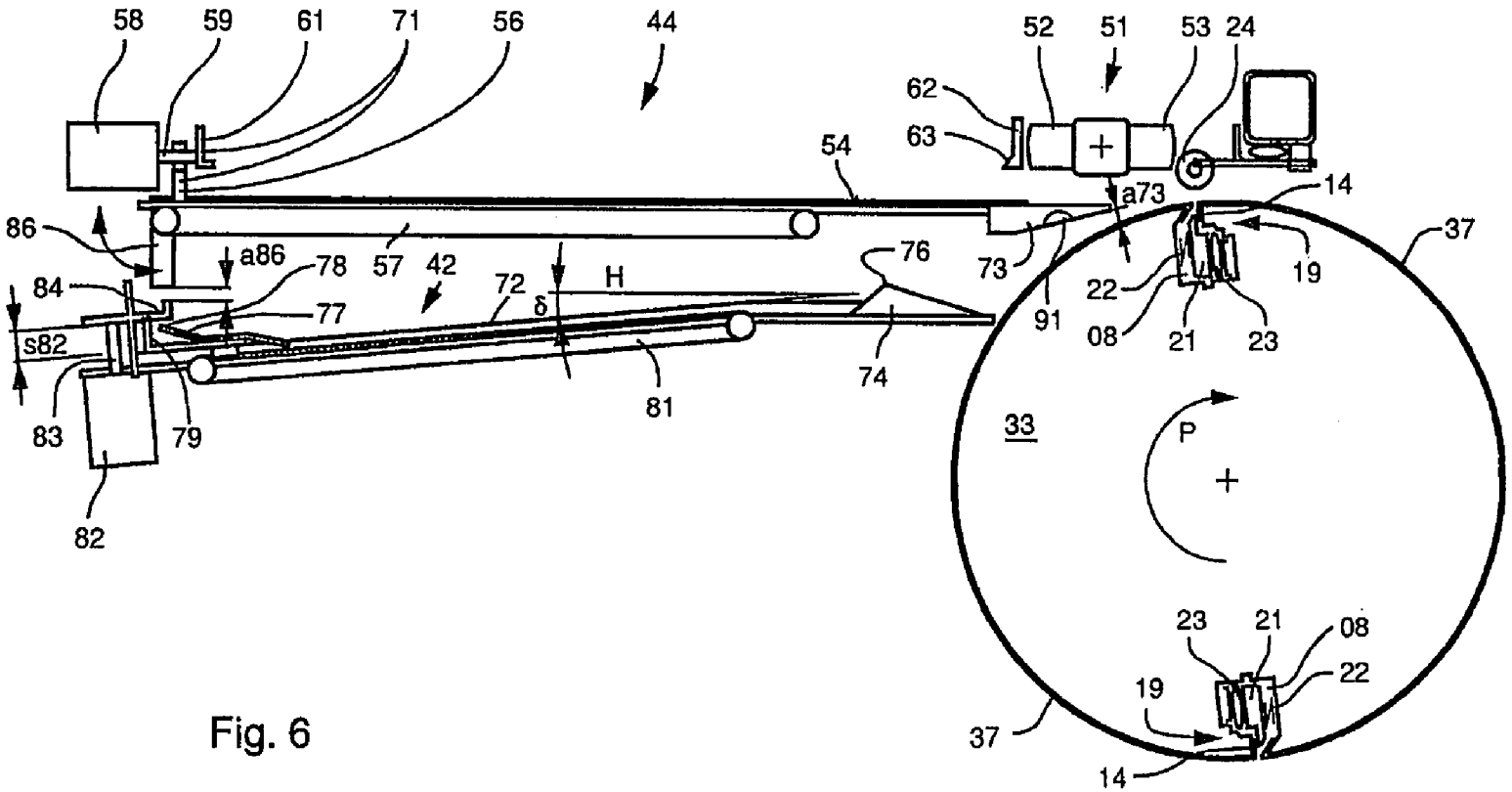

Further details regarding a method and a device for executing the method in accordance with the present invention will now be explained, by way of example, by referring to FIGS. 6 to 35. FIG. 6 shows a forme cylinder 33 with two grooves 08, that are offset by 180° along the cylinder circumference, and two printing formes 37 arranged one behind the other along the cylinder circumference. The trailing end suspension leg 14, which is beveled at right angles, is maintained at the forme or dressing trailing end 04, viewed in the production direction P of the forme cylinder 33, of each printing forme 37 by a holding device 21, which is arranged in a groove 08 and which is charged with pressure by a spring element 22, on a wall 19. The wall 19 extends from a rear edge 17 of an opening 09, which opens the groove 08, toward the groove 08, wherein the holding device 21 can be released by actuating a pneumatic actuating element 23, which acts opposite the spring element 22. At the wall 18, extending from the front edge 16 of the same opening 09 to the groove 08, the suspension leg 13, which is beveled at an acute angle, is placed, with positive contact, against the leading end 03 of the other printing forme 37, which is arranged along the circumference of the forme cylinder 33. For details of the holding of the printing forms, reference is made to FIG. 2.

Moreover, FIG. 6 shows a contact pressure element 24, in the form of a contact pressure cylinder 24 or a contact pressure roller 24, which can be placed against the forme cylinder 33 by pneumatic activation. In the same way, an alignment device 51, with two diametrically arranged, wing-shaped stops 52, 53 acting laterally on the printing forme 37, is provided near the forme cylinder 33 and is pivotably seated parallel to the axial direction of the latter. By use of respectively one of its stops 52, 53, the alignment device 51 temporarily fixes a printing forme 37 to be mounted in place, with respect to the side register, while it is brought to the forme cylinder 33. In this case, the stops 52, 53 are each configured, for example, as lateral guide plates, wherein the stops 52, 53 are arranged, for example, on a pivotable cross bar, for example on a square tube. The stops 52, 53 differ, for example, in their position with respect to the axial direction of the forme cylinder 33, so that, for example, for a printing forme 37 of single width, the stop 52 is employed, and for a printing forme 37 in panorama format, the stop 53 is employed by an appropriate pivoting of the alignment device 51. The stops 52, 53 can be adjusted axially with respect to the forme cylinder 33 for the required width of the printing forme 37.

Further details of the printing forme magazine 39 can also be seen in FIG. 6. The preferred embodiment represented in FIGS. 6 to 35 is based on a variation of the printing forme magazine 39, wherein an upper chute 44, for use in making available a printing forme 37 to be mounted on the forme cylinder 33, can be operated as an autonomous structural unit independently of a lower chute 42, for use in receiving a printing forme 37 removed from the forme cylinder 33. Both chutes 42 and 44 can be used as individual structural units, which can be employed independently of each other and which are therefore autonomously functional. This application is of interest, for example, if only the feeding of the forme cylinder 33 with fresh printing formes 37 is to be automated, while the removal of used printing formes 37 is performed by an operator. If both chutes 42, 44 are embodied in the printing forme magazine 39, a fully automatic printing forme changer results. Both chutes 42, 44 each have all of the devices required for storing and for conveying printing formes 37 and are preferably each very compactly constructed. In particular, both chutes 42, 44 have a low structural height in spite of their being capable of receiving at least two printing formes 37. The structural height is, for example, less than 150 mm, and preferably is less than 100 mm.

In the preferred embodiment represented in FIGS. 6 to 35, the upper chute 44 is horizontally arranged and is aligned tangentially to the forme cylinder 33. In this way, the gravitational force FG exerted on the printing forme 37 is used, in the best possible way, for aiding the functions described in what follows. A support 54, such as a sliding rail or strip, on which the beveled suspension legs 13, 14 of a first printing forme 37 to be mounted on the forme cylinder 33 can be set or placed, is located in the chute 44. A printing forme 37 placed on the support 54 rests thereon, for example, with its entire linear length L. Preferably the support 54 is not embodied as a solid surface, but instead is constituted in the form of parallel strips 54 or sliding rails 54. The suspension leg 14, at the trailing end 04 of the first printing forme 37, rests in the chute 44, on the side of the chute 44 facing away from the forme cylinder 33, against a stop 56, which stop 56 preferably extends vertically. The stop 56 can be moved by a conveying device 57 linearly, and parallel with the support 54, in the direction toward the opening o39 of the printing forme magazine 39, for the purpose of conveying this first printing forme 37 out of the chute 44 by the use of a translatory movement, and preferably maintaining forme 37 free of deformation, at least long enough so that the suspension leg 13 at the leading end of this first printing forme 37 can engage the slit-shaped opening 09 of the forme cylinder 33. In this way, the stop 56 is used as the contact position for the first printing forme 37 in the chute 44, and simultaneously also has the function of a pusher 56. If this first printing form 37 has at least one register stamping at the suspension leg 14 on its trailing end 04, the stop 56 can also be advantageously embodied, for example, as a register pin 56, which extends perpendicularly with respect to the support 54 and which is connected with the conveying device 57. During placing of the first printing forme 37 against the stop 56, pre-registration of the first printing forme 37, with respect to its side register, takes place. The conveying device 57 is embodied, for example, as a belt drive 57, or as a linear drive mechanism 57, is embodied preferably as a pneumatic linear drive mechanism 57, and, in particular, is embodied as a linear drive mechanism 57 without a piston rod, which acts double-sided.

Figure 13:
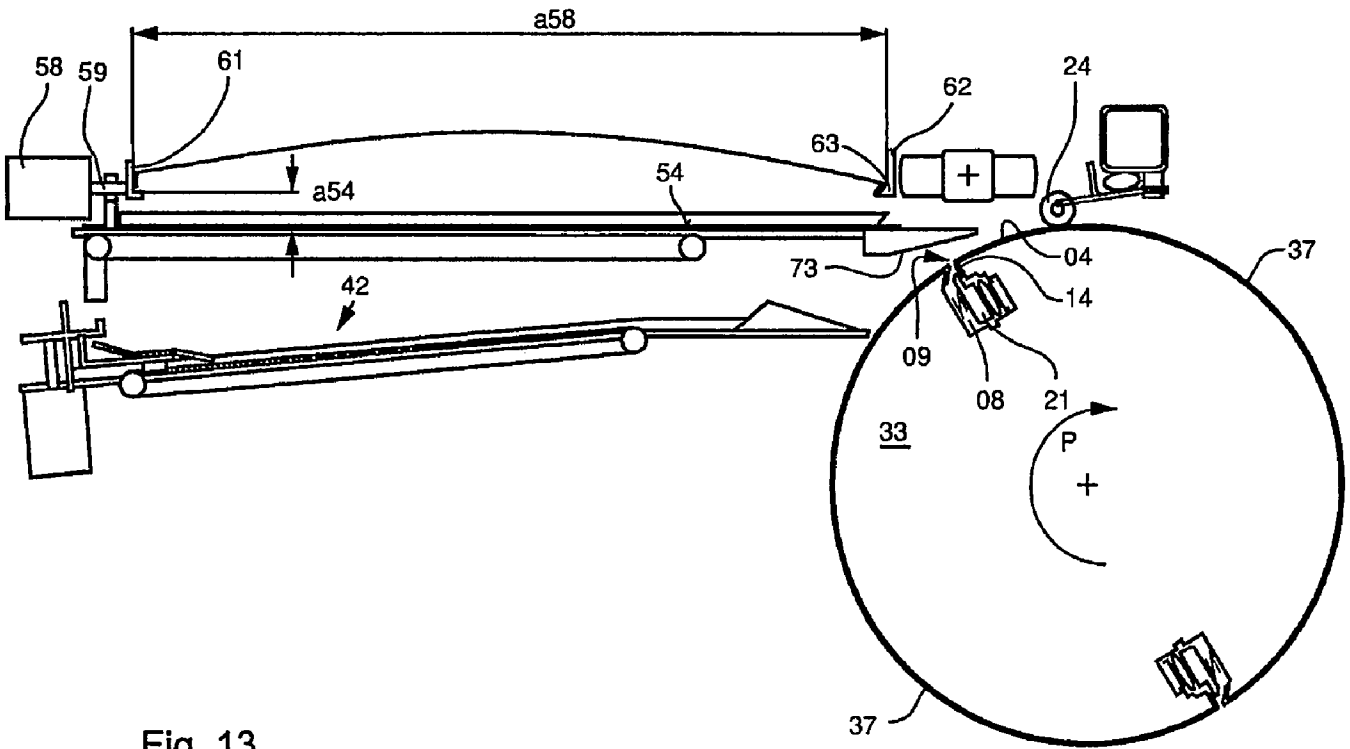

A holder 58, and in particular a printing forme holder 58, is also located in the chute 44, for use in holding at least one second printing forme 37 to be mounted on the forme cylinder 33. As represented in FIG. 13, the second printing forme 37 is held by the printing forme holder 58 above the support 54, i.e. at a distance a54 above the support 54. The printing form holder 58 has, for example on the side facing away from the forme cylinder 33, a piston 59 or a pusher 59, which can be displaced parallel, with respect to the support 54, and at whose end a holding element 61, for example an L-shaped elbow 61, is arranged. The second printing form 37 is accordingly clamped between the elbow 61 of the extended pusher 59 and a further holding element 62, for example a rigidly arranged stop 62, which is arranged in the area of the opening o39 of the printing forme magazine 39. In this case, the distance a54 has a value which preferably lies between twice and four times the length l14 of the suspension leg 14 at the trailing end 04 of the second printing form 37. Clamping of the second printing forme 37 is provided because a free distance a58 between the elbow 61 of the extended pusher 59 and the stop 62 is set to be shorter than the linear length L of the second printing forme 37. Preferably, the stop 62, in the area of the opening o39 of the printing forme magazine 39, has an inclined face 63, on which the suspension leg 13 of the leading end 03 of the second printing forme 37 can be supported against. The inclined face 63 of the stop 62 and the L-shaped elbow 61, on which the suspension leg 14 on the trailing end 04 of the second printing form 37 is supported, face each other. Since the second printing form 37 is flexible, in particular along its length L, it arches in the state where it is clamped between the elbow 61 and the stop 62. The pusher 59 of the printing forme holder 58 is preferably movable parallel, with respect to the support 54, and preferably has two stable operating positions, namely a first stable operating position in the retracted state, in which the second printing forme 37 is released, and a second stable operating position in the extended state, in a position clamping the second printing forme 37. In a variation of the printing forme holder 58, the arrangement of the movable pusher 59 and the rigid stop 62 have been interchanged with each other, so that the pusher 59 is located in the area of the opening o39 of the printing forme magazine 39, and the stop 62 is located on the side of the housing facing away from the forme cylinder 33. Alternatively to the above described linear mobility, the elbow 61 of the stop 62 can also be arranged to be pivotable around a pivot axis that is aligned parallel with the width B of the printing forme 37. A printing forme 37, which is clamped between the elbow 61 and the stop 62, is in its upper, or first storage position, while, in this state, a printing form 37, which is deposited on the support 54, takes on a lower, second storage position, wherein the printing forme 37 is temporarily stored in the second, storage position prior to its conveyance to the forme cylinder 33. By the use of an actuating element, preferably by an actuation by remote control, for example from a control console, which is part of the printing press, the printing forme 37 changes, inside the chute 44, from its upper, first storage position, into it lower, second storage position. Printing formes 37 stored in the first, storage position and in the second storage position, are spaced apart from each other, for example along their length L at the distance a54, so that they cannot touch each other and therefore cannot damage each other.

Figure 7:
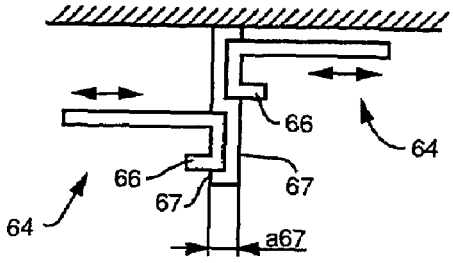
Figure 8:
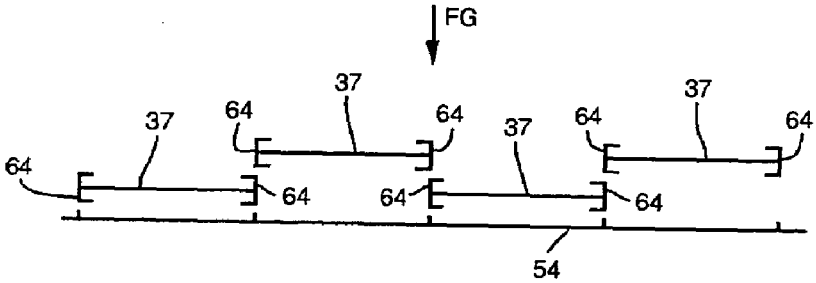
Figure 9:
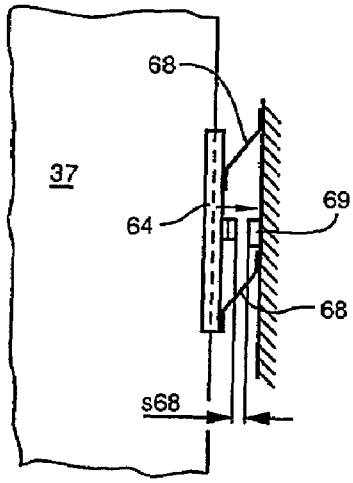

A further preferred embodiment of the printing forme holder 58 is depicted in FIGS. 7–9 and advantageously permits a particularly low structural height of the chute 44, provides for the second printing forme 37 to be maintained above the support 54, which second printing forme 37 extends on a single plane in the axial direction of the forme cylinder 33 in an upper storage position, by the use of at least one holding element 64, wherein the holding element 64 is configured, for example, as a guide rail 64, and preferably as two guide rails 64 extending parallel with each other. The guide rails 64 maintain the second printing forme 37 present in the chute 44 in the upper storage position on its two longitudinal sides over at least a portion of their length L. The embodiment of the printing forme holder 58 with guide rails 64 assumes that, by not extending as far as the longitudinal sides of the printing forme 37, the suspension legs 13, 14 at the ends 03, 04 of the second printing forme 37 do not extend over the full length B of the printing forme 37. Therefore, the longitudinal sides of the printing forme 37 provide a projection, in the area of the bearing area 02, past the suspension legs 13, 14. This projection is necessary for making the guidance of the printing forme 37 in the guide rails 64 possible. The holding element 64, which, in particular, is each guide rail 64, consists, for example, of a U-shaped bracket 66, which extends around each of the longitudinal sides of the printing forme 37 with a certain amount of play, and into which the second printing forme 37 can be inserted from the side facing away from the forme cylinder 33. Thus, the second printing forme 37 is preferably supported by the guide rails 64, along a narrow area of its side, wherein the holder acts, in particular, as a vertical support, and therefore the holder acts as a support against the gravitational force FG acting on the printing forme 37. Preferably, the guide rails 64 are made of a dimensionally stable material, such as a metal or plastic material.

For depositing a second printing forme 37, which is maintained in the guide rails 64, on the support 54, at least one of the guide rails 64 is movable in the direction of the width B of the second printing forme 37. However, both guide rails 64 are preferably movable in opposite directions along the width B of the second printing forme 37, so that they move away from each other, at least for a short period of time, and thereby increase their distance from each other, in such a way that they no longer support the longitudinal sides of the printing forme 37 vertically. The second printing forme 37 thus falls between the guide rails 64 onto the support 54 because of the gravitational force FG acting on it. If, in a first operational mode, the holding element 64 holds the second printing forme 37 in the upper storage position by an electrical or magnetic force, for example, the holding element 64 changes, preferably by remote control, from a first operational state into a second operational state. The second operational state causes the holding element 64 to release the printing forme 37 from the holding element 64, so that, in the course of being released from the holding element 64, the printing forme 37 changes, by free falling in the chute 44, and therefore only because of the gravitational force FG acting on it, into the storage position which preferably is located directly vertically underneath the upper storage position. In the upper, as well as in the lower storage position, the second printing form 37 is held in the chute 44 with an inclination of less than 15°, and is preferably held horizontally. At least the longitudinal extension of the guide rails 64, embodied as support bearings for the second printing forme 37, have only this slight inclination, or preferably extend horizontally.

The release of the second printing forme 37 from the guide rails 64, which act laterally on it, is preferably aided by a stop 67, which stop 67 extends perpendicularly, in relation to the bearing area 02 of the second printing forme 37 and which stop 67 is preferably arranged rigidly in the chute 44. Such a stop 67 is preferably arranged at both longitudinal sides of the second printing forme 37, so that, in the course of a movement in opposite directions of the guide rails 64 which hold this printing forme 37, which movement is directed along the width B of the second printing forme 37, this second printing plate 37 remains in a stable position in the plane defined by the bearing area 02 because of the stops 67 arranged on both sides. The stops 67 push the printing forme 37 off the guide rails 64, which guide rails 64 move away from each other, so that the printing forme 37 comes into contact with the stops 67. The vertical support of the printing plate 37 is simultaneously removed by the movement of the guide rails 64. The release of the second printing forme 37 is preferably performed by a drive mechanism 69, for example, which is operated by remote control from a suitable control console, which control panel is a part of the printing press, wherein the drive mechanism 69 acts on the guide rails 64 and moves them along an actuating path s68.

If several printing formes 37 are to be arranged side-by-side in the axial direction on the forme cylinder 33, and several printing formes 37 are arranged side-by-side in the axial direction of the forme cylinder 33 in the chute 44, it is advantageous to arrange the guide rails 64, which act on adjoining printing formes 37, in the printing forme magazine 39 on two different levels above the support 54, i.e. vertically offset in relation to each other, as shown in FIG. 8, wherein successive levels are preferably alternatingly offset in the axial direction of the forme cylinder 33. By the offset arrangement of the levels, which constitute the first storage position of the printing formes 37, it is possible to keep a distance a67 between printing formes 37, which are arranged side-by-side in the axial direction of the forme cylinder 33, and thus which are next to each other, as short as possible. The value of the distance a67 preferably corresponds to a distance which printing formes 37 have, which printing formes 37 are arranged side-by-side on the forme cylinder 33 in the axial direction of the latter, i.e. adjoining printing formes 37. Printing formes 37 which have been placed on the support 54 from levels which are arranged side-by-side in the axial direction of the forme cylinder 33, i.e. respectively from a first storage position, and which therefore have been brought into their second storage position, can be conducted, either individually or preferably together at the same time, to the forme cylinder 33 by the conveying device 57. This latter method is advantageous for accomplishing a rapid change of printing formes 37 at the forme cylinder 33. Printing formes 37, stored in the axial direction of the forme cylinder 33 in different side-by-side arranged levels, can be changed at the same time, or at least in rapid succession, into their respective second storage positions. Printing formes 37 fed simultaneously together to the forme cylinder 33 are arranged side-by-side on the forme cylinder 33 in its axial direction.

In the configuration represented in FIG. 8, four second printing formes 37 have been arranged, in their respective first storage positions, side-by-side in the axial direction of the forme cylinder 33. Each one of these printing formes 37 is maintained, at its respective longitudinal sides, in a guide rail 64. Here, the vertical offset of the printing formes 37 is only a few millimeters, for example 4 mm to 6 mm, and approximately corresponds to the structural height of the guide rails 64, and preferably to their single or double structural height. The movement of the guide rails 64 longitudinally in relation to the width B of the second printing forms 37 is accomplished, for example, by a linear displacement of the guide rails 64. However, it can also be performed by a pivoting movement of the guide rails 64, wherein the guide rails 64 are pivotable around a pivot axis and wherein the pivot axis extends parallel with respect to the side of the printing forme 37 that is supported by the guide rails 64. For example, a guide rail 64 can be attached to at least one pivot arm 68 which, for example, is pivotable in a plane defined by the bearing area 02 of the second printing forme 37, which plane is indicated by a directional arrow in FIG. 9. The pivot arm 68, whose one end is connected with the guide rail 64, and whose other end is preferably fixed in place in the chute 44, can, for example, be configured as a spring element 68, for example, as a leaf spring 68, which acts laterally on the guide rail 64. The guide rail 64, which is connected with the pivot arm 68, is moved by the drive mechanism 69, which may be for example a controllable, and in particular a remotely controllable, magnet 69, into an operational position in which it holds the second printing forme 37, or into an operational position, wherein it is released from this printing forme 37. The actuating path s68 that is performed by a movable guide rail 64 longitudinally with respect to the width B of the second printing forme 37, lies within the range of a few millimeters, for example between 2 mm and 10 mm, and preferably at 4 mm. A stop 67 is also preferably provided in this embodiment, into which the printing forme 37 comes into contact with its side supported by the guide rail 64, while the guide rail 64 removes this support of the printing forme 37 by being moved. Two printing formes 37, which adjoin each other in the axial direction of the forme cylinder 33, can come into contact with opposite sides of the same stop 67. In the course of changing from the upper storage position into the lower storage position, the printing forme 37 can also glide along the stop 67 with one of its sides directed vertically downward, so that the printing forme 37 released from its upper position reaches the lower storage position by a guided movement. In this case, with a printing forme 37 changing its storage position, the stop 67 fulfills the function of a lateral guidance, which lateral guidance preferably extends as far as the support 54.

Expressed generally, a method for storing at least two dressings 01, 36, 37, which are sequentially removed from the same cylinder 06, 31, 33 of a printing press, includes the following steps: a) a first dressing 01, 36, 37, previously removed from a cylinder 06, 31, 33, is conveyed from a first storage position into a second storage position, b) a second dressing 01, 36, 37 removed following the previously removed first dressing 01, 36, 37, is stored in the first storage position initially occupied by the previously removed dressing 01, 36, 37, c) the previously removed dressing 01, 36, 37 in its second storage position, and the subsequently removed dressing 01, 36, 37 in its first storage position of the previously removed dressing 01, 36, 37, are stored at a distance, which is orthogonal along their length L, d) the dressings 01, 36, 37 are stored with their respective bearing areas 02 at least largely overlapping, preferably overlapping by 80%, or with their bearing areas 02 positioned for complete or almost complete overlap. The previously removed dressing 01, 36, 37, and the subsequently removed dressing 01, 36, 37, can now be stored vertically along their length L, or also spaced apart horizontally from each other. The previously removed dressing 01, 36, 37 is preferably conveyed into its second storage position by a linear movement, in particular by a linear movement which connects both storage positions immediately and directly with each other, orthogonally, in respect to its bearing area 02, or also by a movement of its trailing end 04, which will be explained in greater detail later.

It is advantageous, as depicted in FIG. 6 to arrange a code reader 71, in particular in the chute 44, for example at the pusher 56, for a first printing forme 37 resting on the support 54, or also at the L-shaped elbow 61 for a second printing forme 37, which code reader 71 reads a code, preferably applied to the suspension leg 14 at the trailing end 04 of each printing forme 37. The code reader 71 thus detects a characteristic for identifying a printing forme in order to check, by a comparison, that preferably is electronically performed in a control unit, by the use of an allocation plan provided for the forme cylinder 33 and stored in the control unit, whether the printing formes 37 placed into the chute 44 correspond to the allocation plan of the intended printing process, and whether the printing formes 37 introduced into the chute 44 for intended allocation are present in the required order. In this way, it is possible, even prior to mounting the printing formes 37 on the forme cylinder 33, to generate an appropriate report, such as, for example, an error report, or a report for warning the press operator of an erroneous mounting, and to feed the report to a control console, for example to a control console assigned to the printing press, and to display it there or at the printing group.

Preferably the coding can also be in the form of a code which can be read by humans, for example a bar code. Therefore, the code reader 71 is preferably arranged in the chute 44 at its end facing away from the forme cylinder 33, wherein a reading direction of the code reader 71 is oriented either parallel with the length L of the printing forme 37, or preferably is oriented parallel with the width B of the printing forme 37. In a preferred embodiment, the code reader 71 is arranged, preferably movable by a linear guide, in or at the chute 44. Alternatively, a movable mirror is provided, which movable mirror is preferably inclined by 45° in relation to the width B of the printing forme 37, and which changes the direction of a detection or reading signal from a coding attached to the printing forme 37 to a code reader 71 arranged at the side of the chute 44. Only a single code reader 71 is thus necessary for reading the codes applied to the printing formes 37 stored in the chutes 44. By using only a single code reader 71 for several stored printing formes 37, it is possible to save considerable costs. When employing only a single code reader 71, the single code reader 71, or the mirror, can be displaced either parallel with respect to the width B of the printing forme 37, i.e. in the axial direction of the forme cylinder 33, preferably along several chutes 44, and/or can be displaced vertically in height along the printing formes 37 stacked in one of the chutes 44, so that the code reader 71, or the mirror, thus detects the coding on printing formes 37 stored in different storage positions. Either the code reader 71, or at least one further sensor 91, can be used for monitoring and/or for checking whether an intended printing forme change has been successfully performed. Errors, such as a double allocation, or an erroneous allocation, such as the mounting of the printing forme 37 at an inappropriate location, can then be avoided, or at least are detectable by the provision of a report which preferably is directed to the control console of the printing press, before extensive damage occurs.

A further or lower chute 42 is represented in FIG. 6, and which is used for receiving printing formes 37 removed from the forme cylinder 33. This lower chute 42 has a support 72 which, for example, is inclined and which, the same as the support 54 in the upper chute 44, is preferably embodied not as a solid surface, but in the form of parallel strips 72 or sliding rails 72, for making available printing forms 37 to be mounted on the forme cylinder 33, wherein the inclination of the support 72 widens the chute 42, preferably on the side of the chute 42 facing away from the forme cylinder 33, so that this chute 42 is easier to access by an operator on the side facing away from the forme cylinder 33. This makes the removal of printing formes 37 stored in the chute 42 easier. The support 72 in the lower chute 42 can be inclined with respect to a horizontal line H by an inclination angle δ, wherein the inclination angle δ can lie between 5° and 15°, and preferably is approximately 7°. In the example represented in FIG. 6, the lower chute 42, for use in receiving printing formes 37 removed from the forme cylinder 33, is located below an upper chute 44 for making available printing formes 37 to be mounted on the forme cylinder 33, which, although constituting a preferred arrangement, is not absolute required. The chutes 42, 44 can also be layered in the opposite sequence, or can be arranged separated from each other.

A preferred embodiment of the chute 42 provides that at least two printing formes 37 can be stored in the chute 42 side-by-side in the axial direction of the forme cylinder 33. This embodiment makes a particularly rapid removal of printing forms 37 possible, in particular if at least two printing formes 37 can be arranged on the forme cylinder 33 in its axial direction, because several printing formes 37 can be removed simultaneously from the forme cylinder 33. If, for example, at least four printing formes 37 can be arranged on the forme cylinder 33 in its axial direction, it is advantageous, for reasons of stability, to arrange, for example, two chutes 42 side-by-side in the axial direction of the forme cylinder 33. Each storage space, defined by the width B of a printing forme 37, in one of these chutes 42 is then configured in such a way that at least as many printing formes 37 can be arranged there, as printing formes 37 can be arranged on the circumference of the forme cylinder 33. The storage of the printing formes 37, at each storage space, takes place in a stack on top of each other. It can be provided that up to a maximum of ten, but at least a minimum of up to eight printing formes 37 can be stored in each one of the chutes 42, so that printing formes 37, which were removed from the forme cylinder 33, can be collected in the chutes 42, and the chutes 42 do not necessarily have to be emptied by the operator after each change of printing formes 37. Regardless of the number of chutes 42 arranged side-by-side, the storage spaces have the same close spacing from each other in the axial direction of the forme cylinder 33 as do the printing formes 37 arranged on the forme cylinder 33.

On the side of the upper chute 44 facing the forme cylinder 33, the upper chute 44 has a guide element 73 for receiving printing formes 37 which are removed from the forme cylinder 33 which guide element 73, at least in the operational state, is arranged close to the surface 07 of the forme cylinder 33 and is embodied, for example, in the form of a guide plate 73, a wedge 73 or a rolling element 73, for example a roller 73, and whose purpose it is to guide the trailing end 04 of a printing form 73, which has been removed from the forme cylinder 33, into the chute 42. A distance a73 of the guide element 73 from the forme cylinder 33 is preferably not much greater than the length l14 of the beveled suspension leg 14 at the trailing end 04 of the printing forme 37. The value a73 of the guide element 73 lies, in particular, between the length and twice the length l14 of the suspension leg 14, as seen in FIG. 6. Since a printing forme 37 to be removed from the forme cylinder 33 touches the guide element 73 with its printed image side, its contact with a rotatably seated rolling element 73 is easier on its surface than would be a sliding contact over a rigidly configured wedge 73. This aspect is of particular importance if the printing forme 37 is to be used again, so that damage to its side used for receipt of the printed image, because of scratches or grinding tracks, should be prevented. A sensor 91 can be attached to the guide element 73 which checks, either in contact with the printing form 37 to be removed from the forme cylinder 33, or preferably without contact, i.e. inductively, whether the suspension leg 14 at the trailing end 04 of the printing forme 37 to be removed from the forme cylinder 33 has, in fact, been released following the actuation of the holding means 21 arranged in the groove 08 of the forme cylinder 33. After performing its check, the sensor 91 sends a signal to, for example, the control console of the printing press. A decision is made, on the basis of the signal transmitted by the sensor 91, whether the process of removing a printing forme 37 to be removed from the forme cylinder 33 can be continued, or whether steps for clearing up an interference must be initiated. Several sensors 91 are preferably provided on the guide element 73 in the axial direction of the forme cylinder 33. For example four or six sensors 91, to provide one sensor 91 for each printing forme 37 can be arranged side-by-side on the forme cylinder 33 in its axial direction can be provided on guide element 73.

Figure 14:
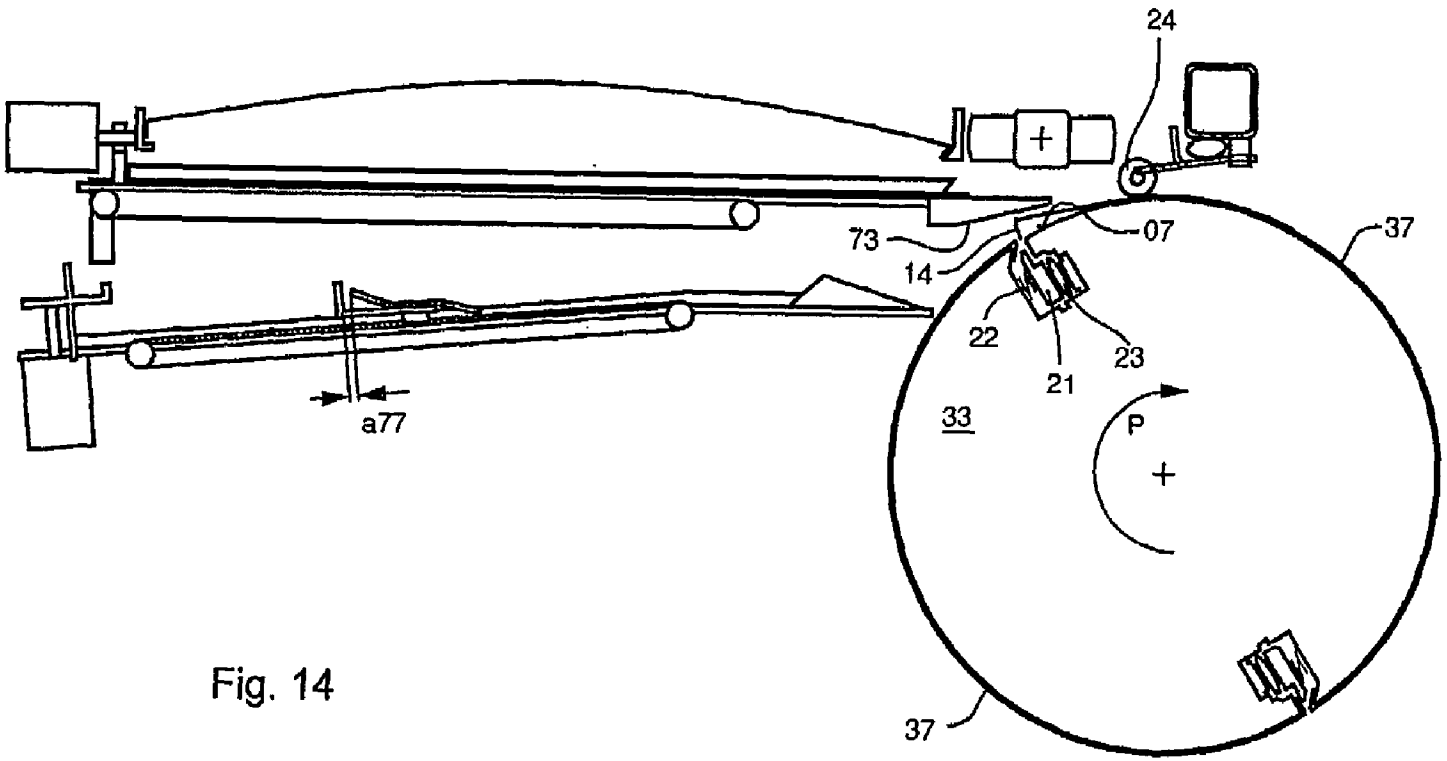

In a preferred embodiment, after having passed the guide element 73, the suspension leg 14 at the trailing end 04 of the printing forme 37 to be removed from the forme cylinder 33 preferably is placed on a first ramp 74, which ramp 74 is arranged in the lower chute 42 at a distance from the guide element 73, before it reaches the support 72. The first ramp 74 initially rises in the direction of the support 72, and after a high point 76 descends again toward the support 72. The first ramp 74 is preferably rigidly connected with the support 72. Continuing the introduction of the printing forme 73 to be removed from the forme cylinder 33 into the chute 42, the printed forme 73 suspension leg 14, at the trailing end 04, arrives at a second ramp 77, whose flank preferably descends abruptly steeply toward the support 72 after its high point 78, i.e. on the side facing away from the forme cylinder 33. In the direction in which the printing forme 37 is introduced into the lower chute 42, a detent 79, which the suspension leg 14 at the trailing end 04 of the forme cylinder 33 contacts, is arranged at a short distance a77, as seen in FIG. 14, after the high point 78 and is rigidly connected with the second ramp 77. The distance a77 has a value of a few millimeters, and preferably has a value of less than the simple length l14, and in particular is less than half the length l14 of the beveled suspension leg 14 at the trailing end 04 of the printing forme 37. When the suspension leg 14 at the trailing end 04 of the printing forme 37 comes into contact with the stop 79, it preferably extends behind the second ramp 77 because of the suspension leg 14 entering an intermediate space formed by the distance a77. The second ramp 77 and the stop 79, which is connected with it, can be moved linearly and parallel with the support 72 by a conveying arrangement 81, for conveying the printing forme 37 to be removed from the forme cylinder 33 completely into the chute 42. The conveying arrangement 81, together with the steep flank at the second ramp 77 for the beveled suspension leg 14 at the trailing end 04 of the printing forme 37, constitutes a moving device for conveying the printing forme 37 into the chute 42. This conveying device is configured as a belt drive 81 or as a linear drive 81, and preferably as a pneumatic linear drive, and in particular as a linear drive 81 acting double-sided without a piston rod. Both the first ramp 74, as well as the second ramp 77, are not made as full-sized planes, for example, but as several associated guide rails, which are arranged parallel like the teeth of a comb. The second ramp 77 can be formed, for example, of one or of several appropriately bent metal strips.

A lifting device 82, and in particular a printing forme lifting device 82, is arranged in the chute 42 on the side facing away from the forme cylinder 33. The printing form lifting device 82 has, for example, a piston 83, which can be shifted perpendicularly with respect to the support 72, and at whose end a lifting arm 84, which is configured to be either L-shaped, for example, or in particular U-shaped, is provided. The beveled suspension leg 14 at the trailing end 04 of the printing forme 37 is placed on the lifting arm 84, or is placed so that it extends around it. Preferably, the printing forme lifting device 82 has two stable operating positions, namely a first stable operating position with the piston 83 retracted, in which the lifting arm 84 is located below the level defined by the support 72, and a further or second stable operating position with the piston 83 extended, in which the lifting arm 84 lifts the printing forme 37 which was removed from the forme cylinder 33, off the support 72. In the lifting process, the printing forme lifting device 82 performs a lift s82, which is greater than the length l14 of the beveled suspension leg 14 at the trailing end 04 of the printing forme 37. Preferably, the lift s82 has a value between the single and double lengths 114 of the suspension leg 14. In this way, the printing forme lifting device 82 lifts a printing forme 37 which had been removed from the forme cylinder 33, from a temporary first storage position into a final second storage position.

A securing element 86, which can be pivoted around a pivot axis extending substantially parallel with respect to the width B of the printing forme 37 and which has, for example, the shape of a strip-shaped flap 86, and whose lower edge is at a distance a86 from the lifting arm 84, and wherein the distance a86 preferably is less than the length l14 of the suspension leg 14 at the trailing end 04 of the printing forme 37, is arranged above the printing forme lifting device 82, and in particular is arranged above its lifting arm 84. In FIG. 6 a directional arrow indicates the pivotability of the securing element 86. The securing element 86 secures a printing forme 37 lifted by the printing form lifting device 82 against inadvertent slipping in the chute 42, or against removal from the chute 42. Thus, an operator must first pivot the securing element 86 before the lifted printing forme 37 can be removed from the chute 42.

Figure 10:
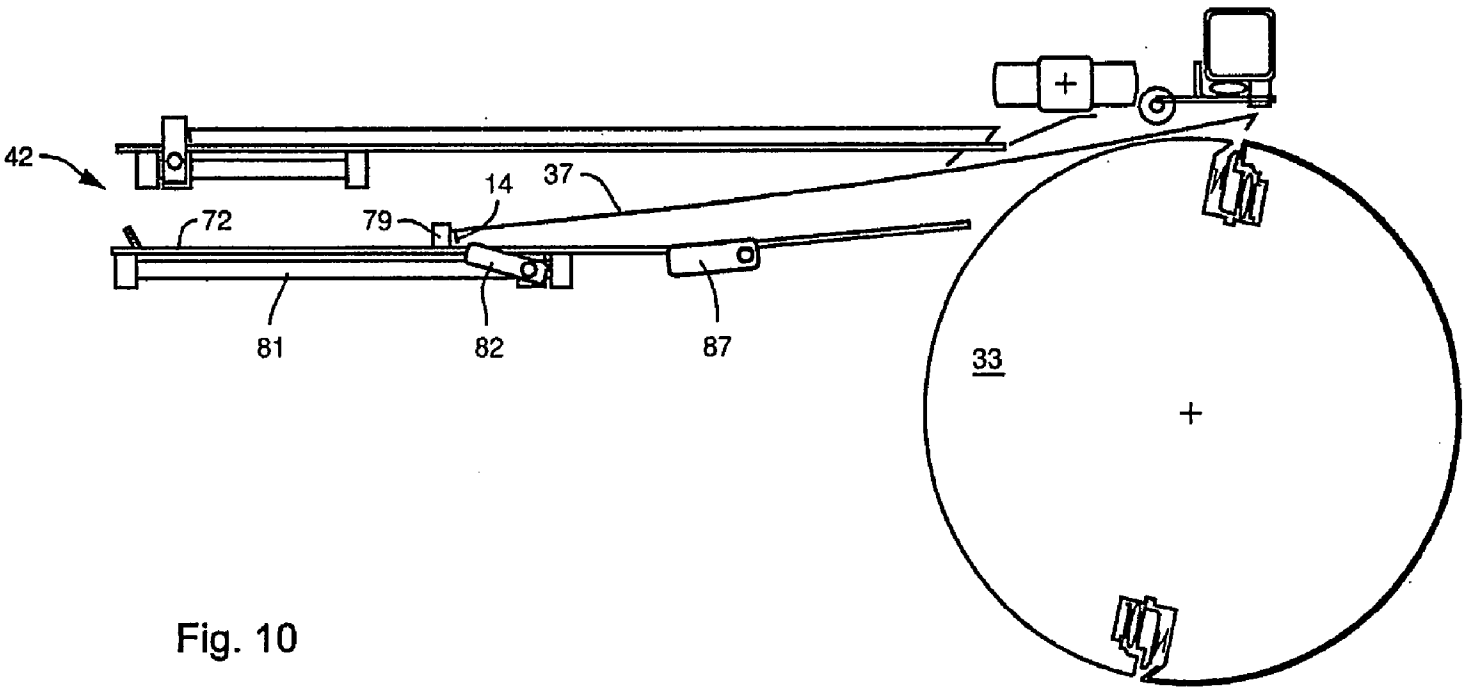
Figure 11:
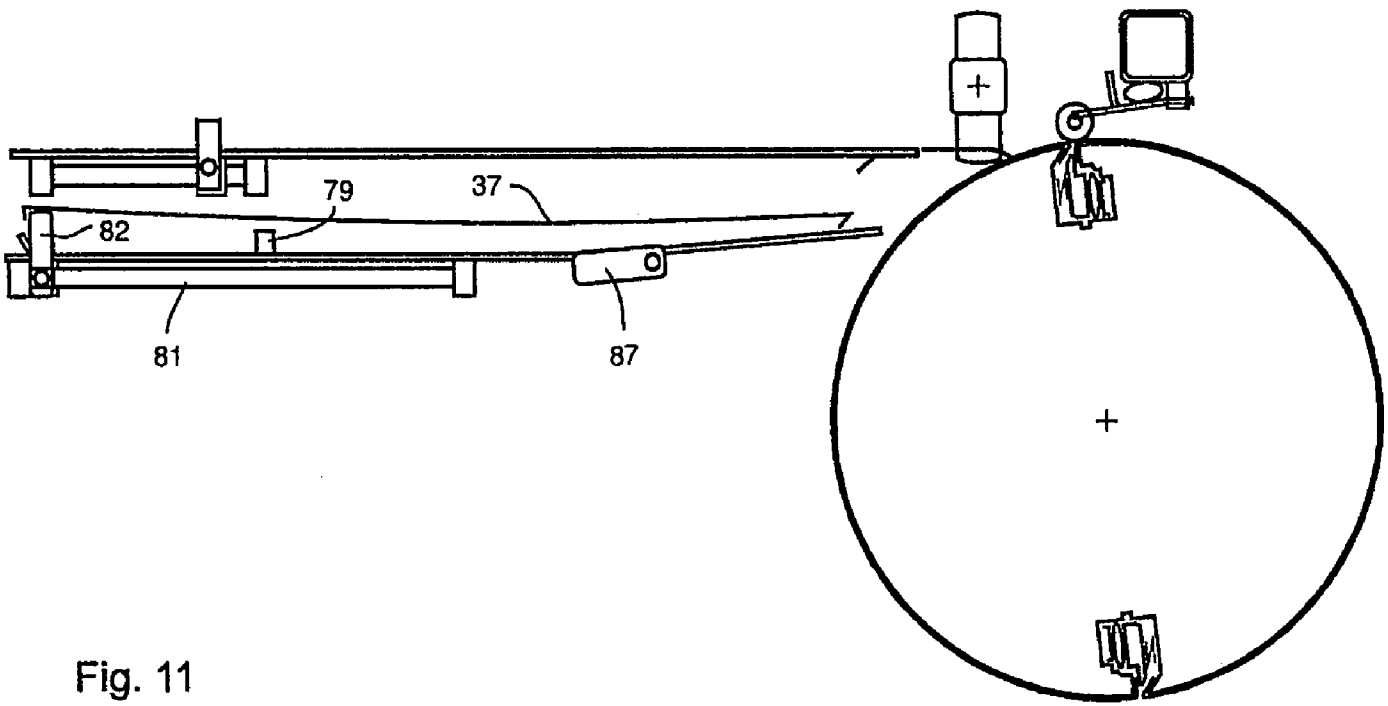
Figure 12:
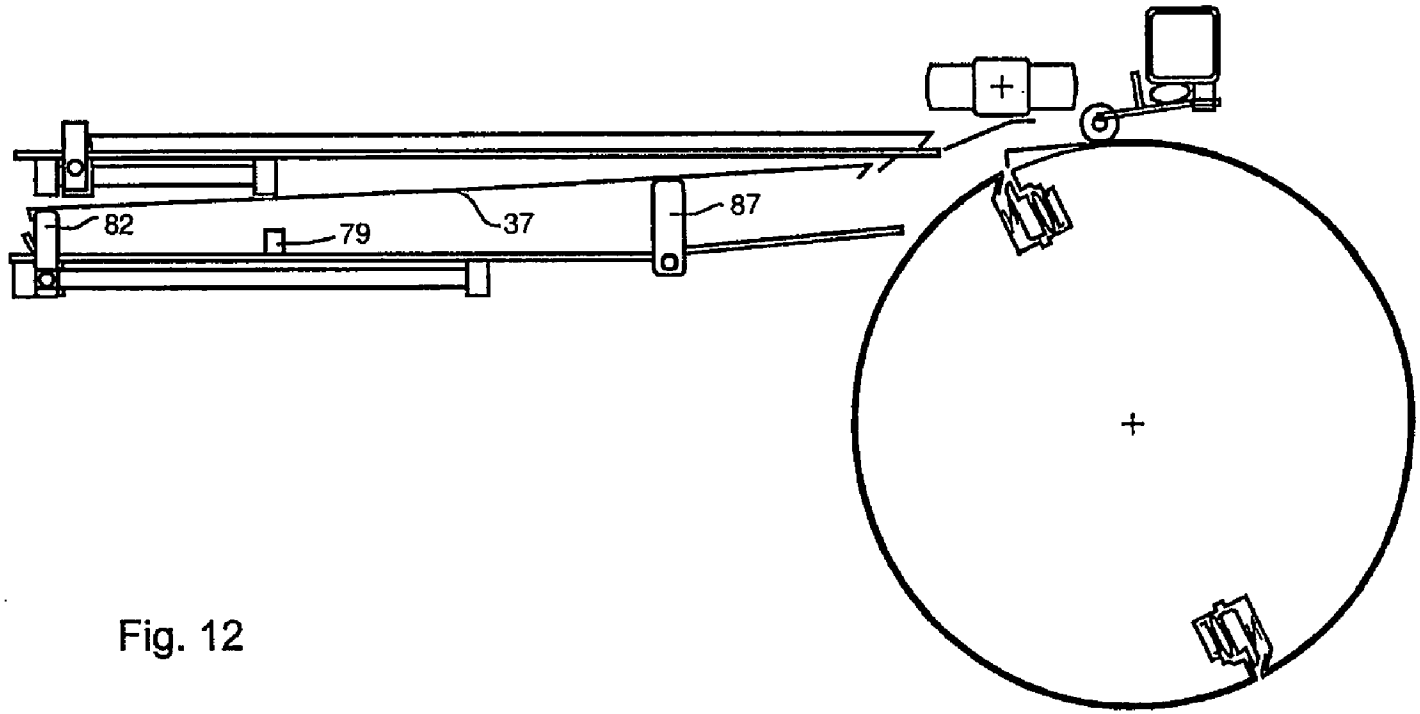

A further preferred embodiment of components arranged in the chute 42 is represented in FIGS. 10 to 12. This preferred embodiment provides a stop 79, which is preferably rigidly arranged in the central area of the support printing forme lifting device 82, which is connected to a conveying arrangement 81 and which can be linearly moved along the support 72, lifts the beveled suspension leg 14 at the trailing end 04 of a printing forme 37 to be removed from the forme cylinder 33 over the support 72, and in its state where it is lifted by the printing forme lifting device 82, pulls the printing forme 37 to the end of the chute 42 facing away from the forme cylinder 33. The conveying arrangement 81 and the printing forme lifting device 82 can be forcibly connected in such a way that the printing forme lifting device 82 lifts the beveled suspension leg 14 of the printing forme 37 at a time at which the conveying arrangement 81 performs a movement in the direction facing away from the forme cylinder 33. Moreover, a further printing forme lifting device 87 is provided between the stop 79 and the end of the chute 42 facing the forme cylinder 33, which further lifting device 87 lifts the leading end 03 of a printing forme 37 which was removed from the forme cylinder 33 and which was inserted into the chute 42, sufficiently far, so that a subsequent printing forme 37 to be removed from the forme cylinder 33, can be inserted into the chute 42 between the support 72 and the lifted, previously removed printing forme 37, as shown in FIGS. 11 and 12.

Special methods for changing printing formes 37 on a forme cylinder 33 will now be explained by particular reference to FIGS. 13 to 35. It is assumed that initially two printing formes 37 are arranged in the upper chute 44 for making available fresh printing formes 37 to be mounted on the forme cylinder 33, that two printing formes 37 are arranged along the circumference of the forme cylinder 37, and that, for receiving printing formes 37 removed from the forme cylinder 33, the lower chute 42 is empty, i.e. is free of printing formes 37.

The forme cylinder 33 rotates so that the opening 09 of a groove 08, in which the suspension leg 14 at the trailing end 04 of the printing forme 37 to be removed from the forme cylinder 33 is maintained by a holding device 21, is moved into a first position which is located below the guide element 73, which is a part of the upper chute 44. The controllable, preferably pneumatically operable contact pressure element 24 is placed against the forme cylinder 33, as seen in FIG. 13.

The actuating element 23, which can preferably be operated pneumatically, pivots the holding device 21 against the force of a spring element 22, so that the suspension leg 14 at the trailing end 04 of the printing forme 37 snaps out of the opening 09 because of its elastic inherent tension and contacts the guide element 73. The contact pressure element 24, which is now placed against the forme cylinder, secures the printing forme 37 against further release from the shell 07 of the forme cylinder 33, as seen in FIG. 14.

Figure 15:
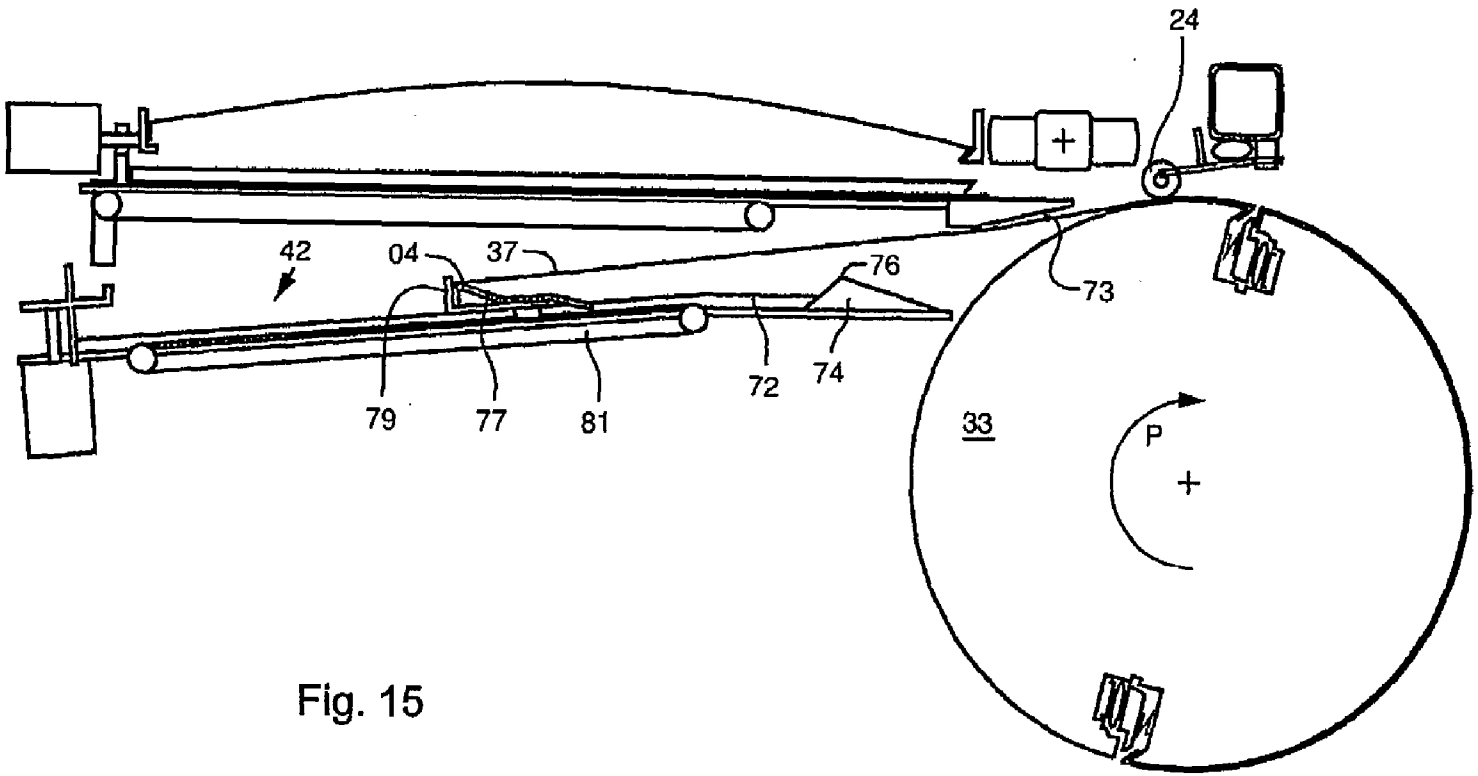
Figure 16:
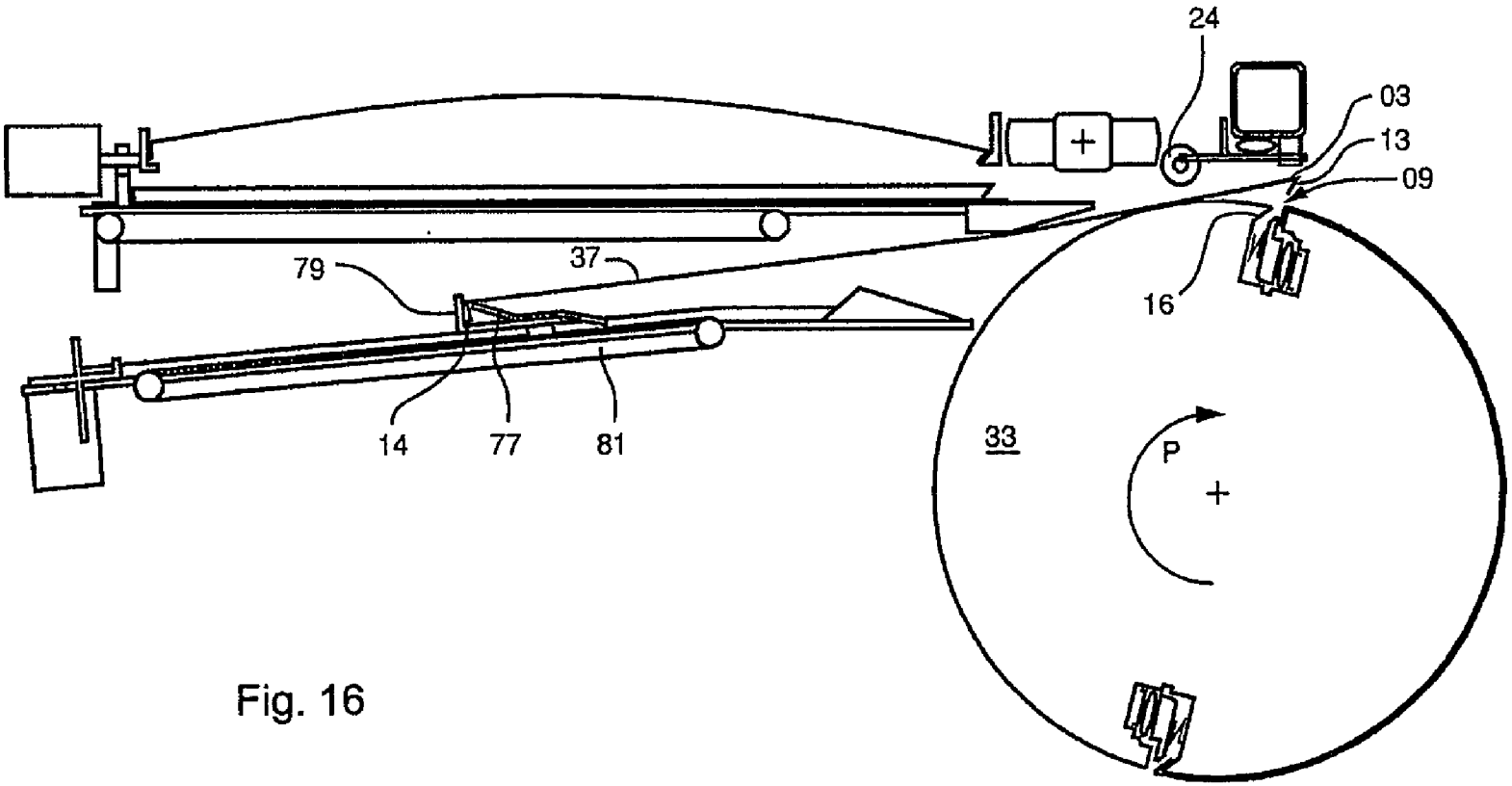

The forme cylinder 33 rotates opposite its production direction P and, in the process, pushes the trailing end 04 of the printing forme 37 into the lower chute 42. In the course of the insertion of the printing forme 37 into the chute 42, the suspension leg 14 at the trailing end 04 of this printing forme 37 first slides along the guide element 73 and is then placed on the first ramp 74, which is a part of the lower chute 42. The suspension leg 14 slides upward on the ramp 74, up to its high point 76, and thereafter reaches the support 72. While the contact pressure element 24 continues to be placed against the forme cylinder 33, the printing forme 37 is further pushed into the lower chute 42 by the rotation of the forme cylinder 33 opposite its production direction P. In the course of this movement, the suspension leg 14 at the trailing end 04 also moves over the second ramp 77, which is connected with the conveying arrangement 81, and contacts the stop 79 which is connected with the second ramp 77, as depicted in FIG. 15.

The contact pressure element 24 is now removed from the forme cylinder 33. Because of the push by the suspension leg 14 of the trailing end 04 against the stop 79, the suspension leg 13 at the leading end 03 of the printing forme 37, which is preferably positively connected and which is suspended at the front edge 16 of the opening 09, is released from the opening 09. Now the printing forme 37 freely rests with its leading end 03 on the shell 07 of the forme cylinder 33. From the release of the trailing leg 14 at the trailing end 04 until now, the forme cylinder 33 has performed less than half a revolution. The beveled suspension leg 14 at the trailing end 04 has been hooked between the second ramp 77 and the stop 79. Now the conveying device 81, which is connected with the second ramp 77 and the stop 79, can pull the printing forme 37 completely into the chute 42. This can be seen by referring to FIG. 16.

Figure 17:
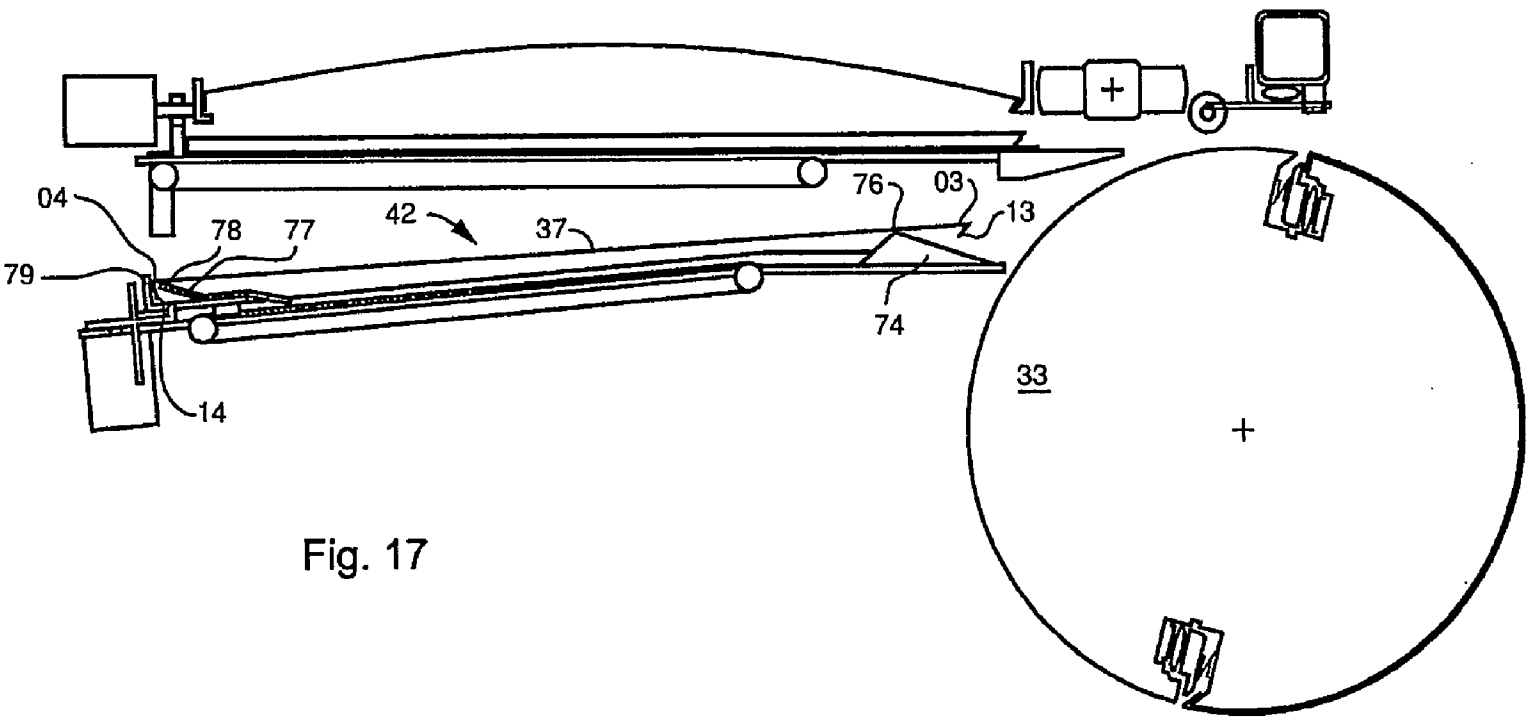

The first printing forme 37 has now been removed from the forme cylinder 33 and is located with its length L in the chute 42. Its suspension leg 14 at the trailing end 04 rests on the high point 78 of the second ramp 77, while it leading end 03 rests on the high point 76 of the first ramp 74, because of which at least the suspension leg 13 at the leading end 07 preferably hangs free. Therefore, the seating of the printing forme 37 in the lower chute 42 is preferably provided by a support of the first removed printing forme 37 at two points, namely at the high points 76, 78 of the two ramps 74, 77, as is shown in FIG. 17.

Figure 18:
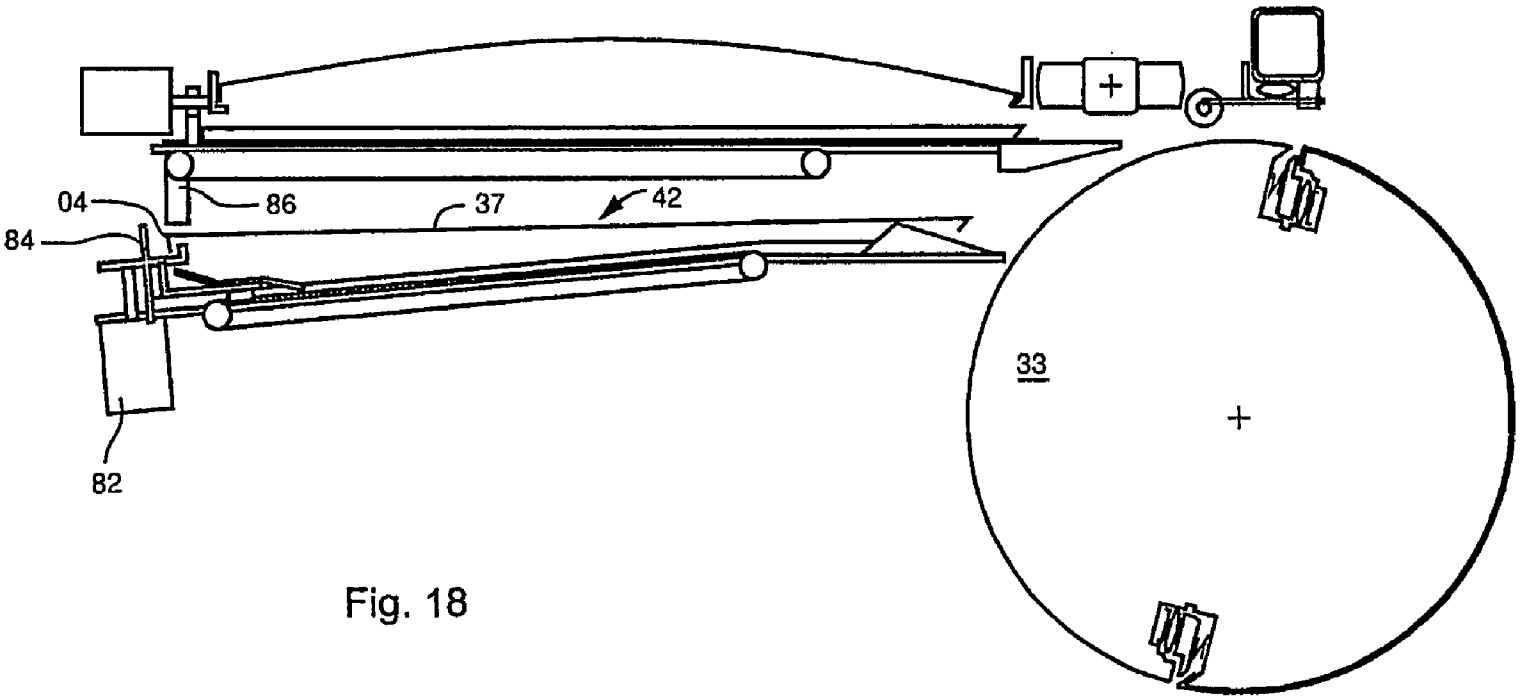

The printing forme lifting device 82, which can preferably be operated pneumatically, for example, lifts the trailing end 04 of the first removed printing forme 37 pulled into the chute 42 to shortly underneath the securing element 86. The suspension leg 14 now stands on the lifting arm 84 connected with the printing forme lifting device 82, as depicted in FIG. 18.

Figure 19:
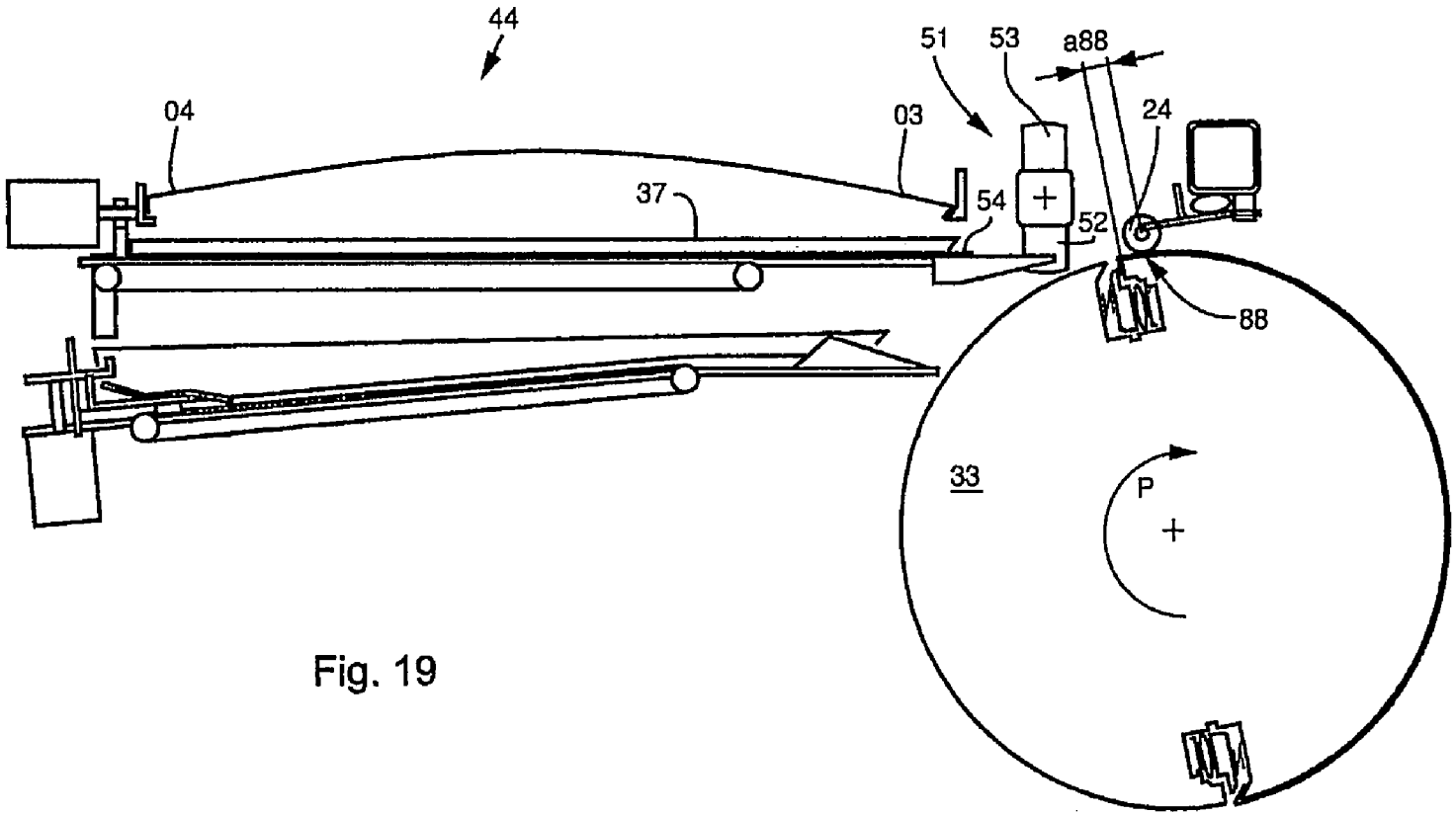

While a first printing forme 37 to be mounted on the forme cylinder 33 rests, with its beveled suspension legs 13, 14 on the support 54, in the upper chute 44, the forme cylinder 33 continues to rotate opposite its production direction P into a second position. The opening 09, from which the suspension leg 13 at the leading end 03 of the printing forme 37 previously removed from the forme cylinder 33 was released, has now passed a contact point 88 of the contact pressure element 24 again placed against the forme cylinder 33, and the rear edge 17 of the opening 09 which, in the production direction P of the forme cylinder, is at the rear, is at a distance a88 from the contact point 88. The distance a88 lies in the range of a few millimeters, and preferably is less than 30 mm, and therefore corresponds to an arc length of less than a one-thirtieth part of the circumference of the forme cylinder 33. As a rule, the first position of the forme cylinder 33 for removing a printing forme 37 arranged on it is not identical to the second position for receiving a fresh printing forme 37. The contact force element 24 is preferably placed against the forme cylinder 33 while the opening 09 passes the contact point 88, or after opening 09 has passed the contact point 88. The alignment device 51, which is arranged close to the forme cylinder 33 pivots with its previously preferably horizontally arranged stops 52, 53, now rotated preferably by 90°, and now turned into a vertical position, so that a stop 52, 53, which is matched to the width B of the printing forme 37 to be mounted on the forme cylinder 33, dips into a transport plane, defined by the support 54 in the chute 44, for the printing forme 37 to be mounted on the forme cylinder 33. The printing forme 37 to be mounted on the forme cylinder 33 is thus aligned with the forme cylinder 33 at the stop 52, 53 with the correct side registration while being transported out of the chute 44 all as seen in FIG. 19.

Figure 20:
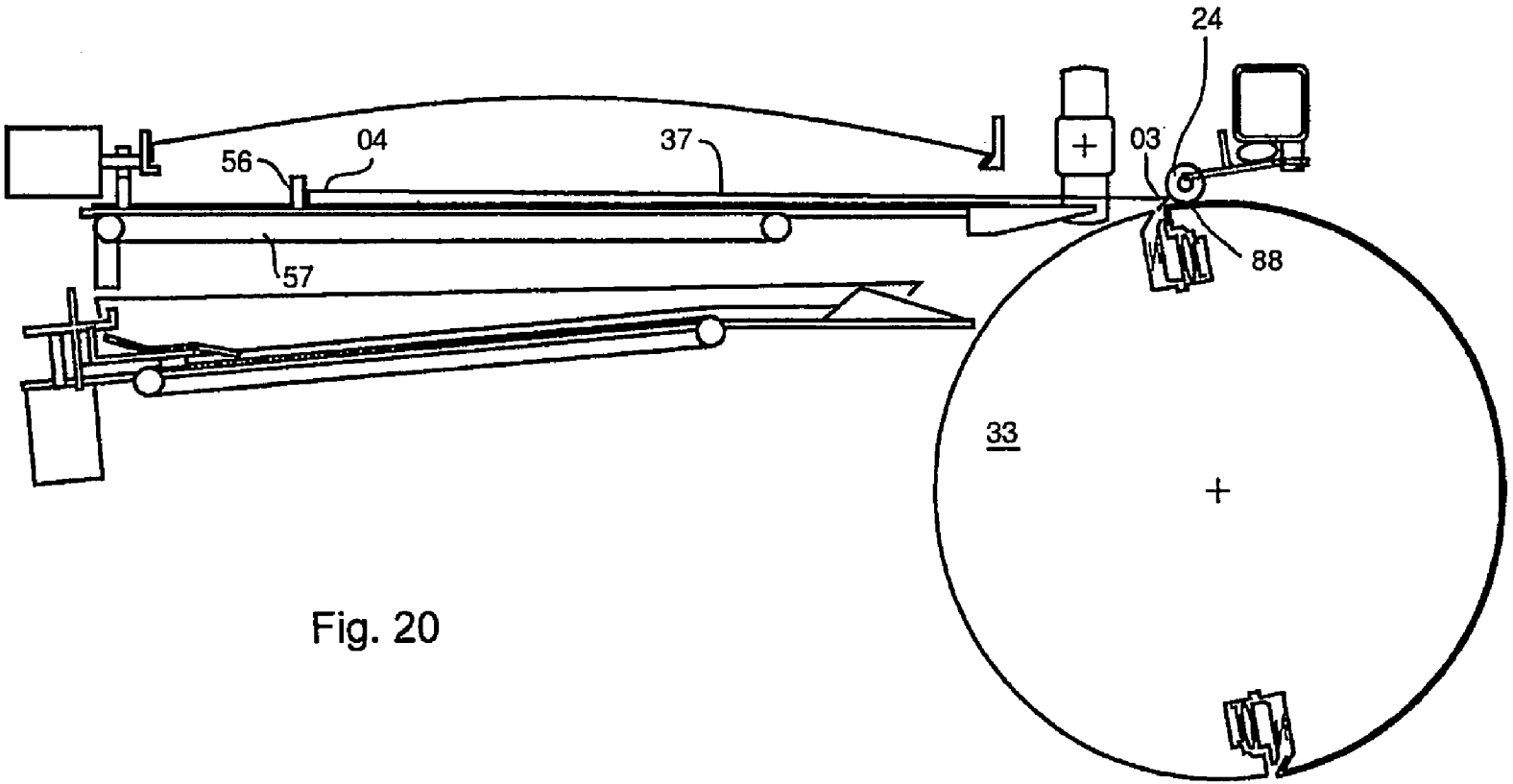

The suspension leg 14 on the trailing end 04 of the first printing forme 37 to be mounted on the cylinder 33 rests against a stop 56, which stop 56 is connected with a conveying device 57. The conveying device 57 is put into operation, so that the stop 56 conveys the first printing form 37 in a movement which is preferably directed tangentially to the forme cylinder 33, and out of the chute 44, until the leading end 03 of printing forme 37 touches the contact force element 24, which was previously placed against the forme cylinder 33, and the beveled suspension leg 13 on this leading end 03 now rests between the edge 17 of the opening 09, which is in the rear in the production direction P of the forme cylinder 33, and the contact point 88 of the contact force element 24, as seen in FIG. 20.

Figure 21:
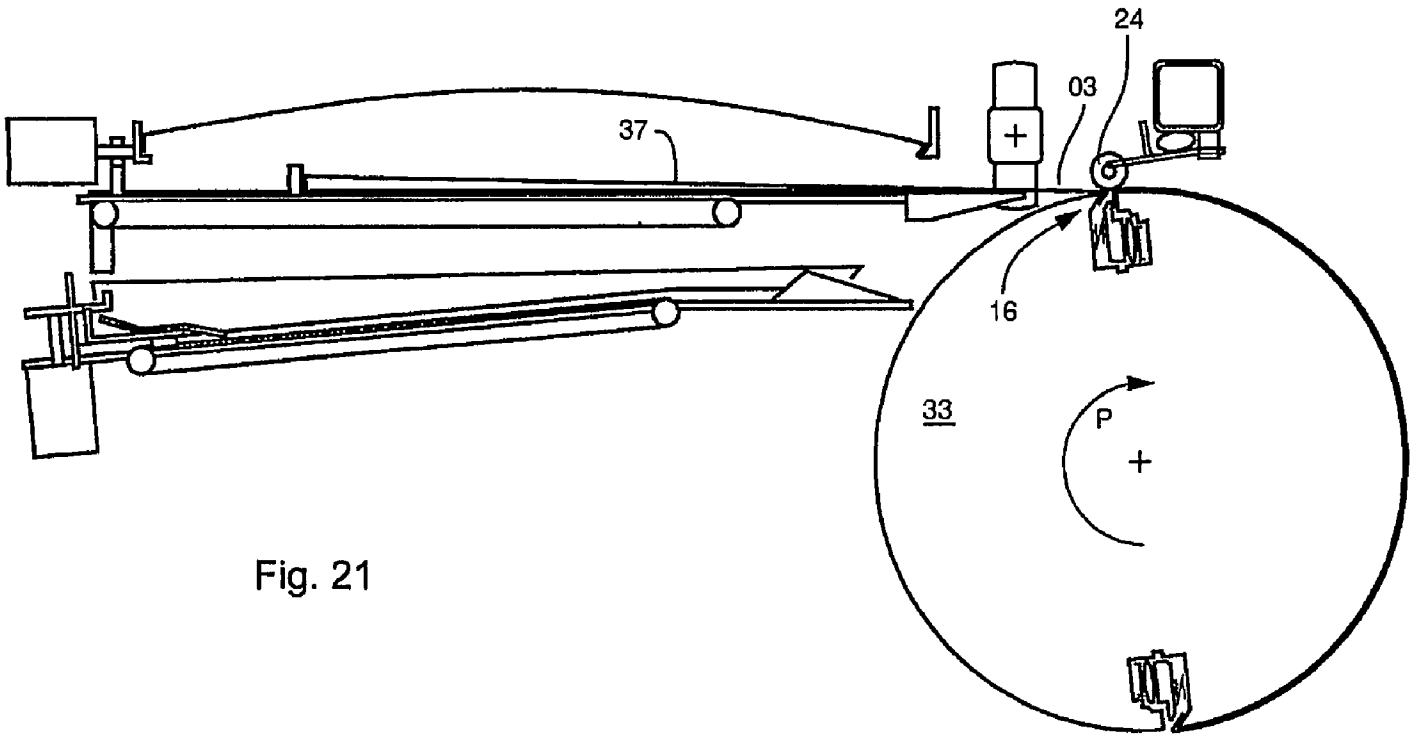

The direction of rotation of the forme cylinder 33 is changed and it again begins to rotate in its production direction P, so that the suspension leg 13 at the leading end 03 of the printing forme 37 being placed on the forme cylinder 33 slides into the opening 09 and is suspended, preferably positively connected, at the front edge 16 of the opening 09. This position is shown in FIG. 21.

Figure 22:
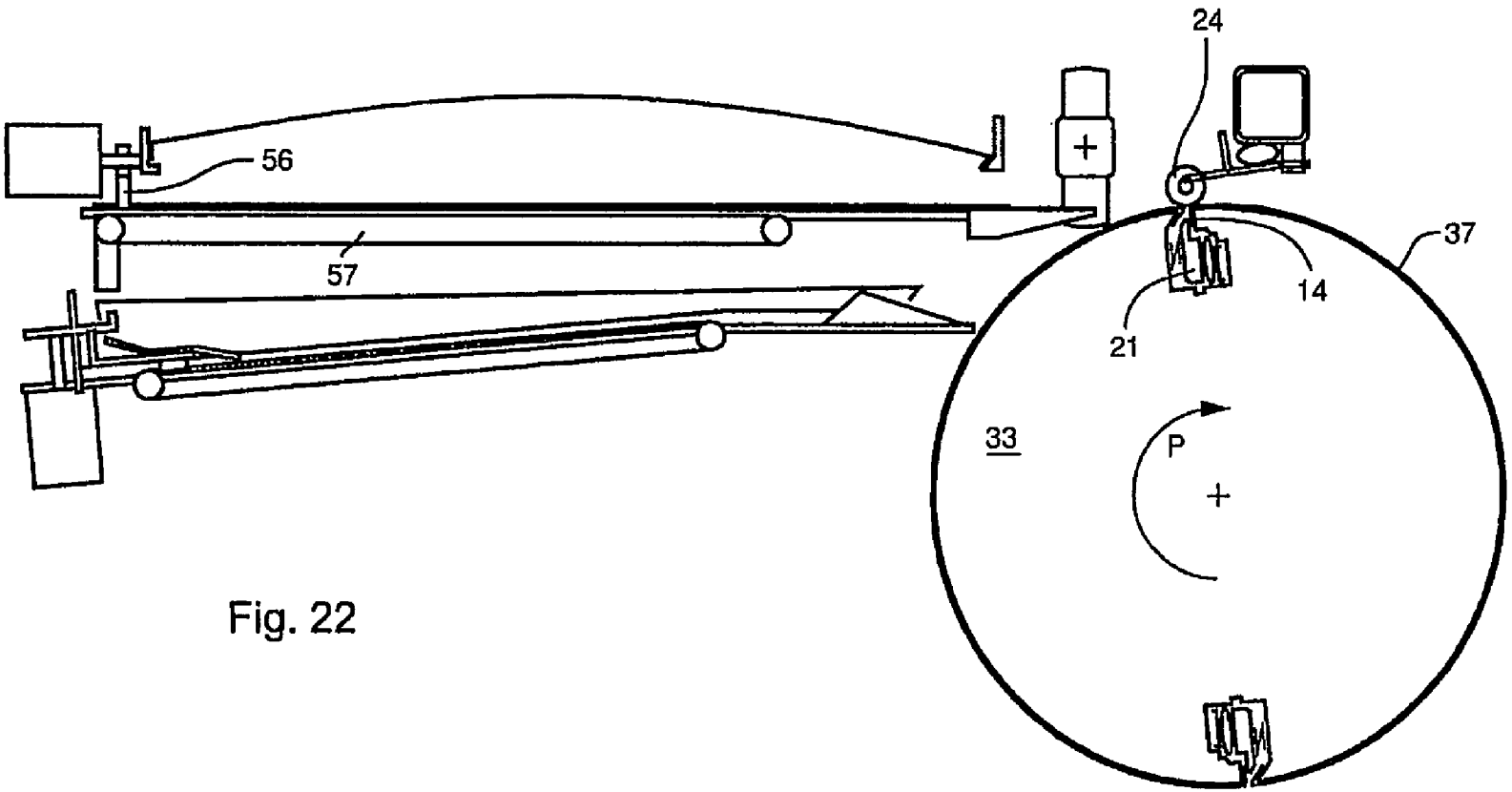

By continued rotation of the forme cylinder 33 in its production direction P, the printing forme 37, whose suspension leg 13 is suspended in the opening 09, is completely moved out of the chute 44 and is drawn onto the forme cylinder 33. In the course of the draw-on process, the printing forme 37 is rolled onto the forme cylinder 33 by the contact force element 24, which is placed against the forme cylinder 33. After half a revolution of the forme cylinder 33 in its production direction P, the contact force element 24 now pushes the beveled suspension leg 14 at the trailing end 04 of the printing forme 37 into the opening 09. The holding element 21 in the groove 08 assigned to this opening 09 was previously released and is now brought into the operating position in which it fixes the suspension leg 14 at the trailing end 04 of the printing forme 37 introduced into the opening 09 in place, for example by clamping. The conveying device 57 now moves the stop 56, which is connected with it, back into its end position on the side of the chute 44 facing away from the forme cylinder, as depicted in FIG. 22.

Figure 23:
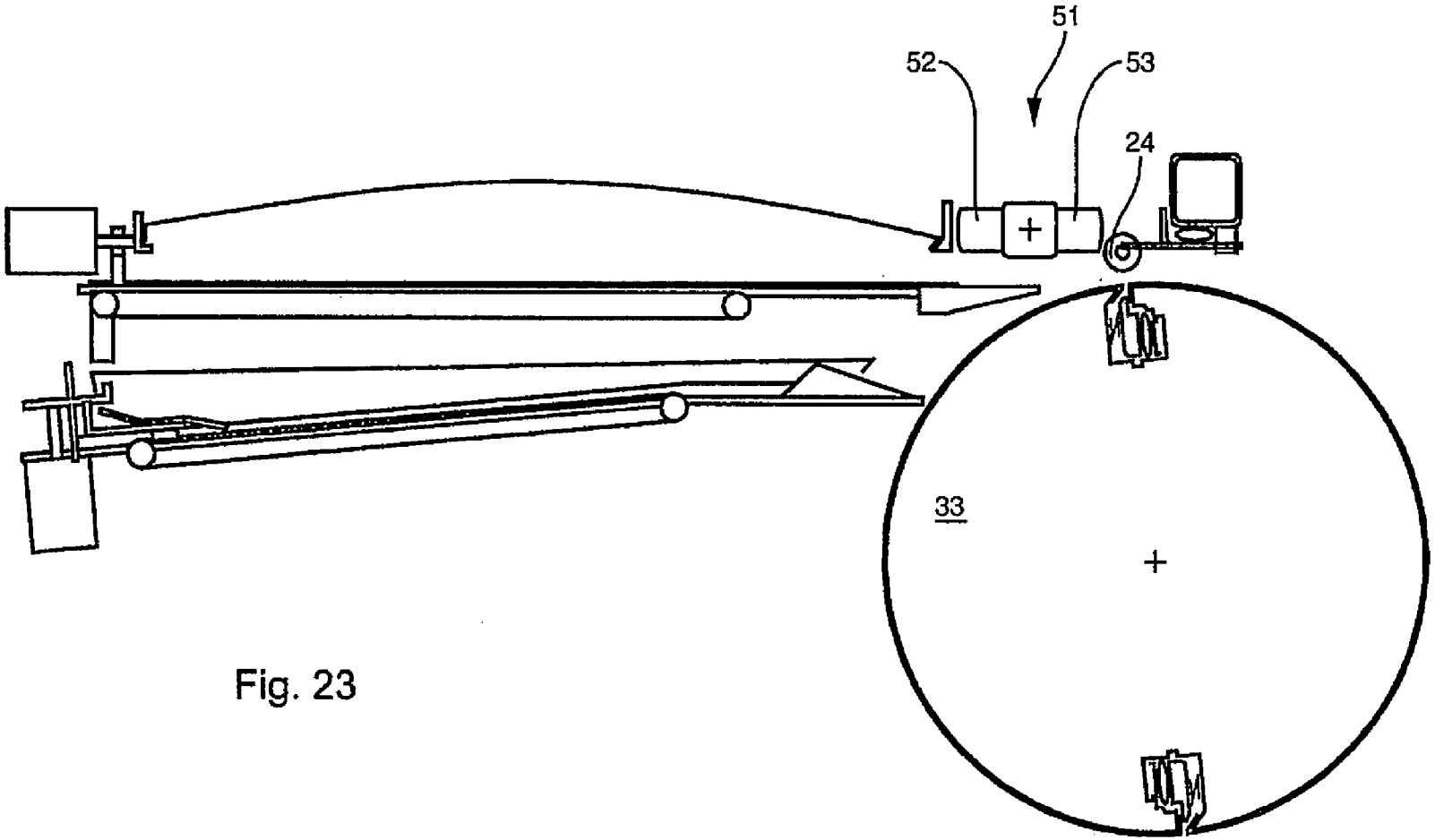

The contact pressure element 24 is again moved away from the forme cylinder 33, and the diametrical stops 52, 53 of the alignment device 51 are preferably again pivoted into a horizontal position. A change of a first printing forme 37 on the forme cylinder 33 is now finished with accordance the above described method steps. A used printing forme 37 has been removed and a fresh printing forme 37 has been attached. This change of a printing forme 37 can be completely performed by the above-described device in a very short time, preferably in less than one minute. Then the forme cylinder 33 is again ready for production, as can be seen in FIG. 23.

Figure 24:
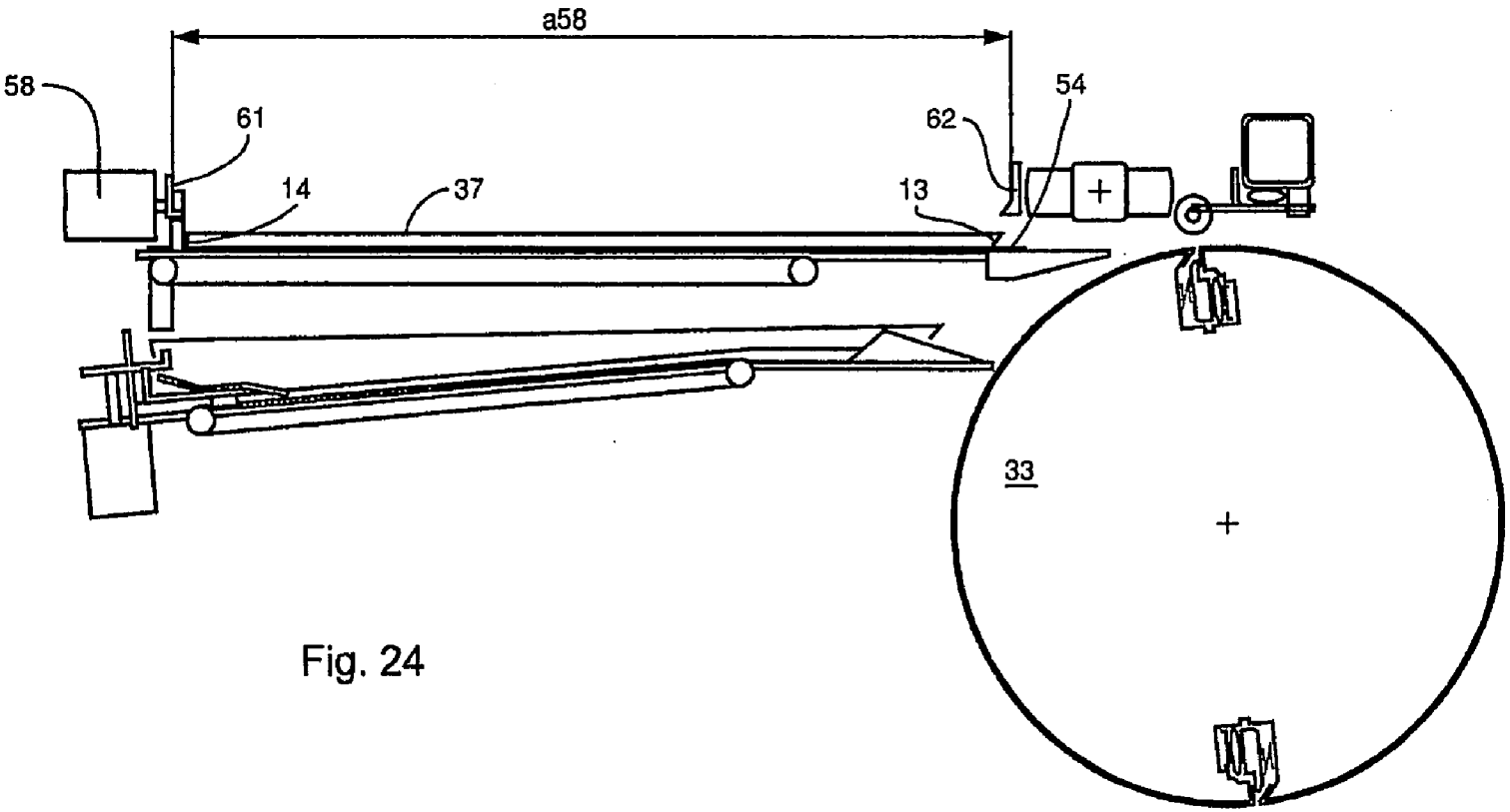

The change of a further, second printing forme 37, for example, which is also arranged along the circumference of the forme cylinder 33, is started by an operator placing the second fresh printing forme 37 into the chute 44, preferably still during the previous running production. The second fresh printing forme 37 was maintained above the support 54 in a controllable, preferably pneumatically controllable printing forme holder 58, so that the second fresh printing forme 37 is clamped, for example either at its ends 03, 04, between two stops 61, 62, for which purpose at least one of the stops 61, 62 is movable, or wherein the second fresh printing forme 37 is inserted with its long sides into guide rails 64, and wherein at least one of the guide rails 64 can be moved along the width B of the printing forme 37. When the printing form holder 58 releases the printing forme 37 in that its elements holding the printing forme 37, for example the stops 61, 62, or the guide rails 64, increase their distance from each other, for example a58, at least briefly, the printing forme 37 falls onto the support 54 and rests thereon with its suspension legs 13, 14, as seen in FIG. 24.

Figure 25:
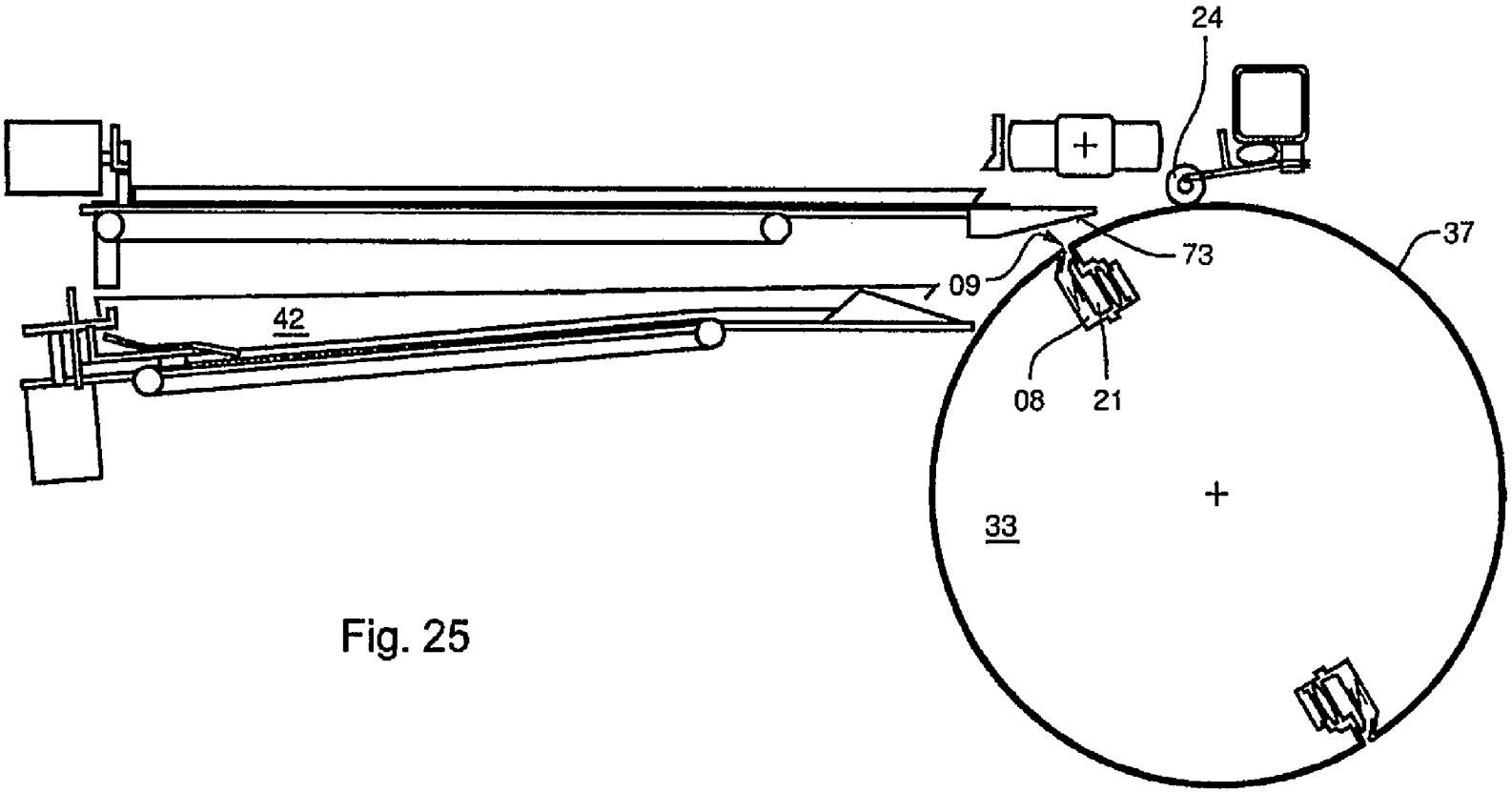

For removing a further, for example a second, used printing forme 37 from the forme cylinder 33, and corresponding to the method previously explained in connection with FIG. 13, the forme cylinder 33 rotates the opening 09 of the groove 08, in which the suspension leg 14 at the trailing end 04 of the second printing forme 37 which is to be removed from the forme cylinder 33, is held by a holding means 21, into the first position, which is located below the guide element 73, which is a part of the chute 44. The controllable, preferably pneumatically operable contact pressure element 24 is now again placed against the forme cylinder 33, as depicted in FIG. 25.

Figure 26:
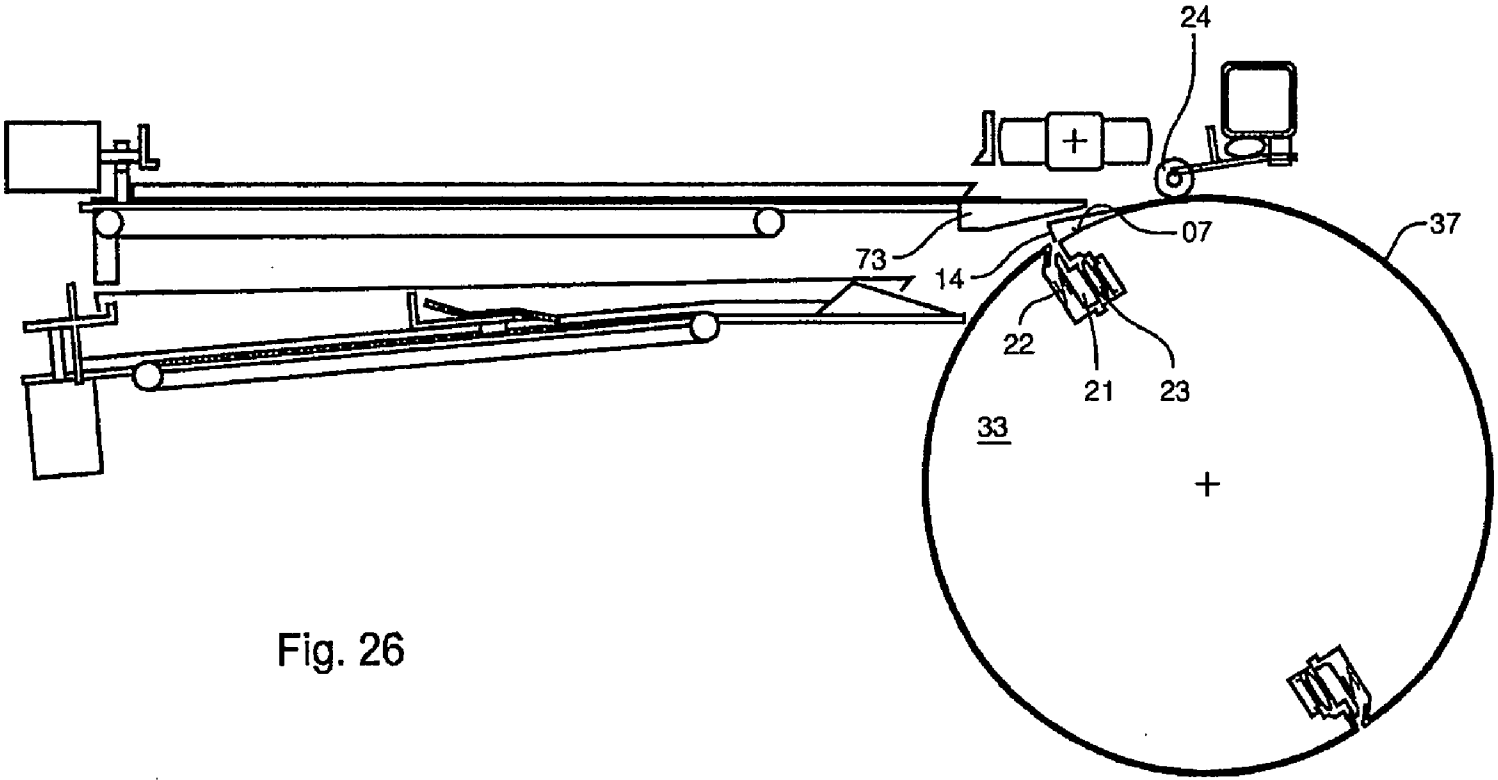

Corresponding to the method previously explained in connection with FIG. 14, the preferably pneumatically operable actuating element 23 pivots the holding device 21 against the force of a spring element 22, whereupon the suspension leg 14 at the trailing end 04 of the second printing forme 37 to be removed snaps out of the opening 09 because of its elastic inherent tension and now contacts the guide element 73. The contact pressure element 24, placed against the forme cylinder, secures the second printing forme 37 against further release from the shell 07 of the forme cylinder 33, as is shown in FIG. 26.

Figure 27:
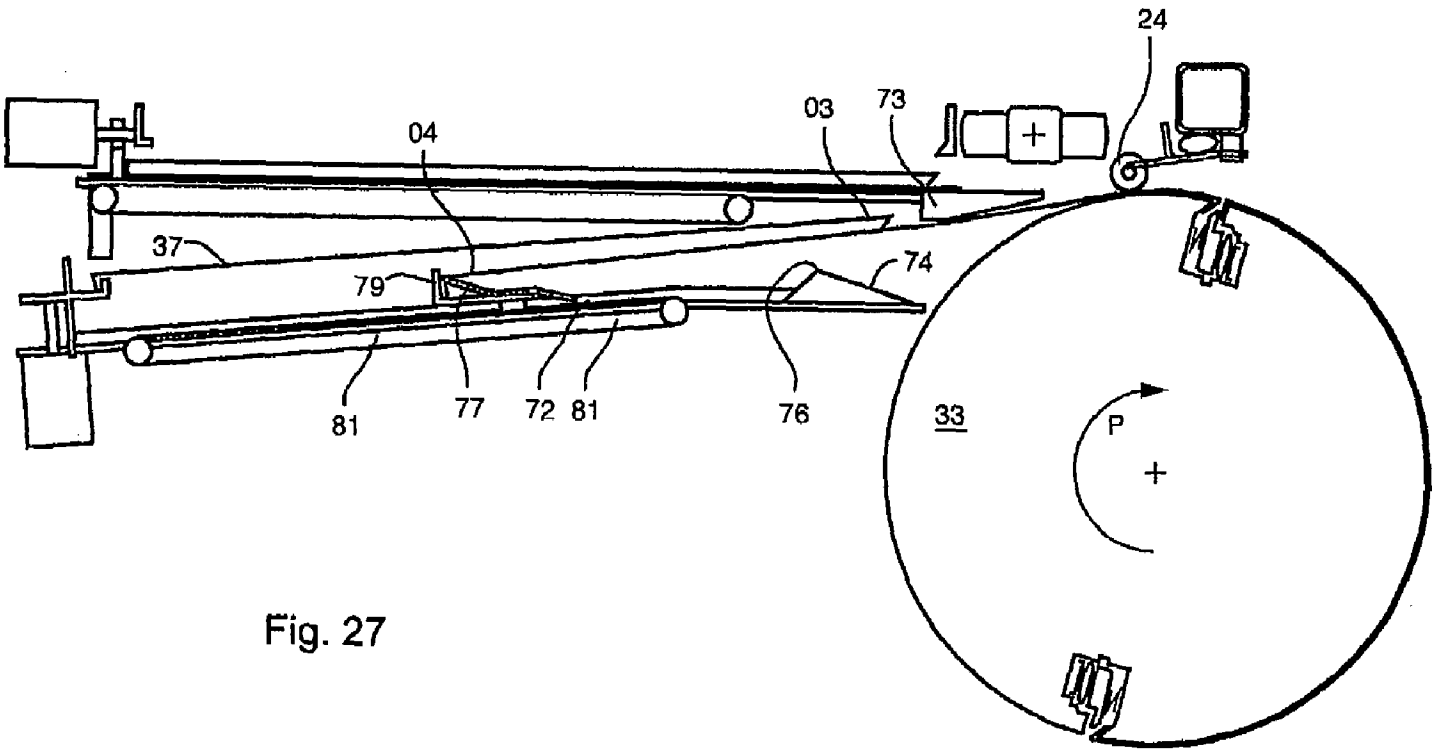

The forme cylinder 33 now continues to rotate opposite its production direction P and, in the process, pushes the trailing end 04 of the second used printing forme 37 into the chute 42. In the course of the insertion of the printing forme 37 into the chute 42, the suspension leg 14 at the trailing end 04 of this second used printing forme 37 first slides along the guide element 73 and is then placed on the first ramp 74, which is a part of the chute 42. The suspension leg 14 of the second used printing forme 37 slides upward on the ramp 74, wherein it is pushed under the first used printing forme 37 resting in the chute 42, which first used printing forme 37 rests on the high point 76 of the first ramp 74, and lifts its leading end 03, which projects past the high point 76 and is oriented toward the forme cylinder 03, while the suspension leg 14 of the second printing forme 37 passes over the high point 76 of the first ramp 44 and thereafter reaches the support 72. While the contact pressure element 24 continues to be placed against the forme cylinder 33, the second used printing forme 37 is pushed further into the chute 42 by the continued rotation of the forme cylinder 33 opposite to its production direction P. In the course of this rotation, the suspension leg 14 at the trailing end 04 of the first printing forme 37 resting in the chute 42 slides over the side with the printed image of the second printing forme 37 conveyed into the chute 42. In the further course of events, the suspension leg 14 of the second used printing forme 37 also moves over the second ramp 77 connected with the conveying arrangement 81 and contacts the stop 79 which is connected with the second ramp 77, as seen in FIG. 27.

Figure 28:
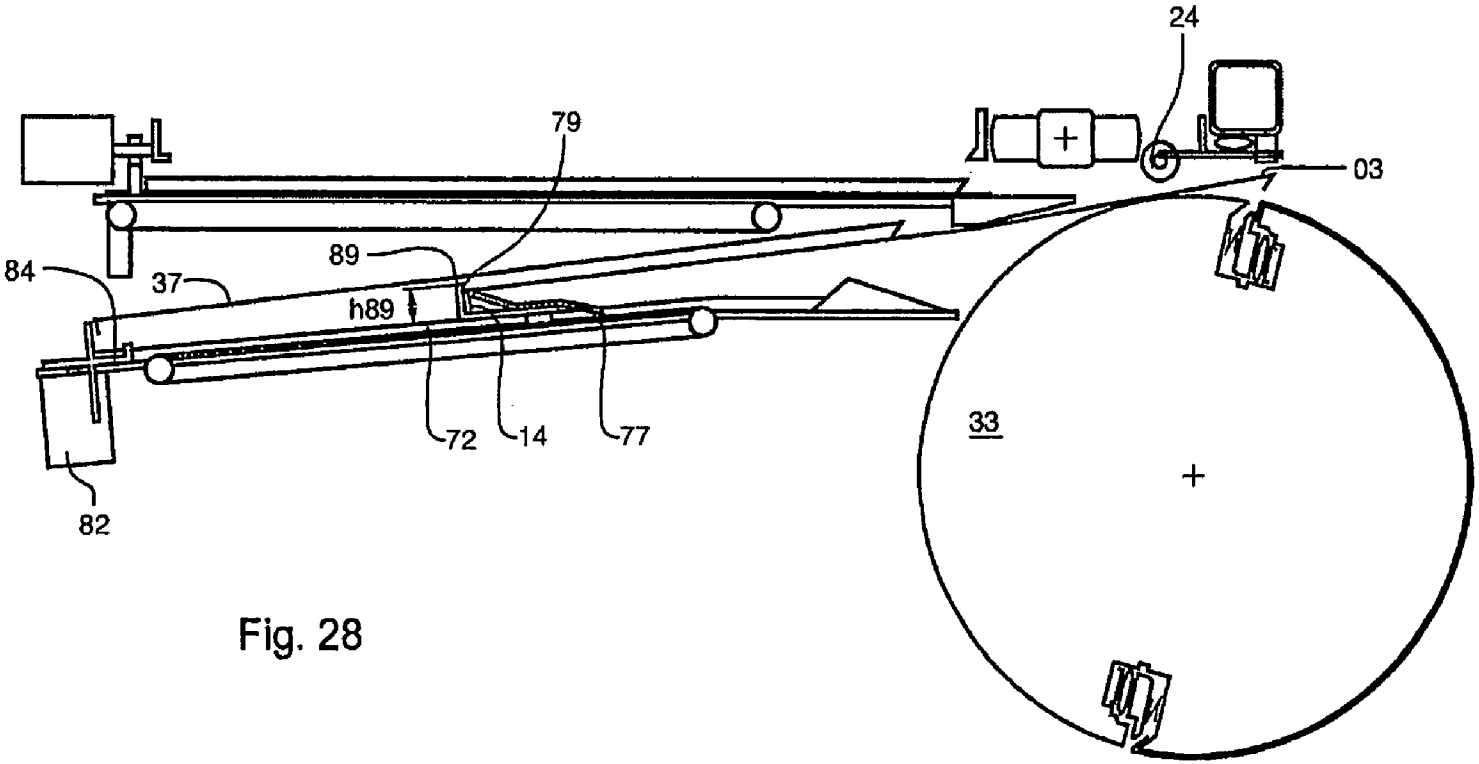
Figure 29:
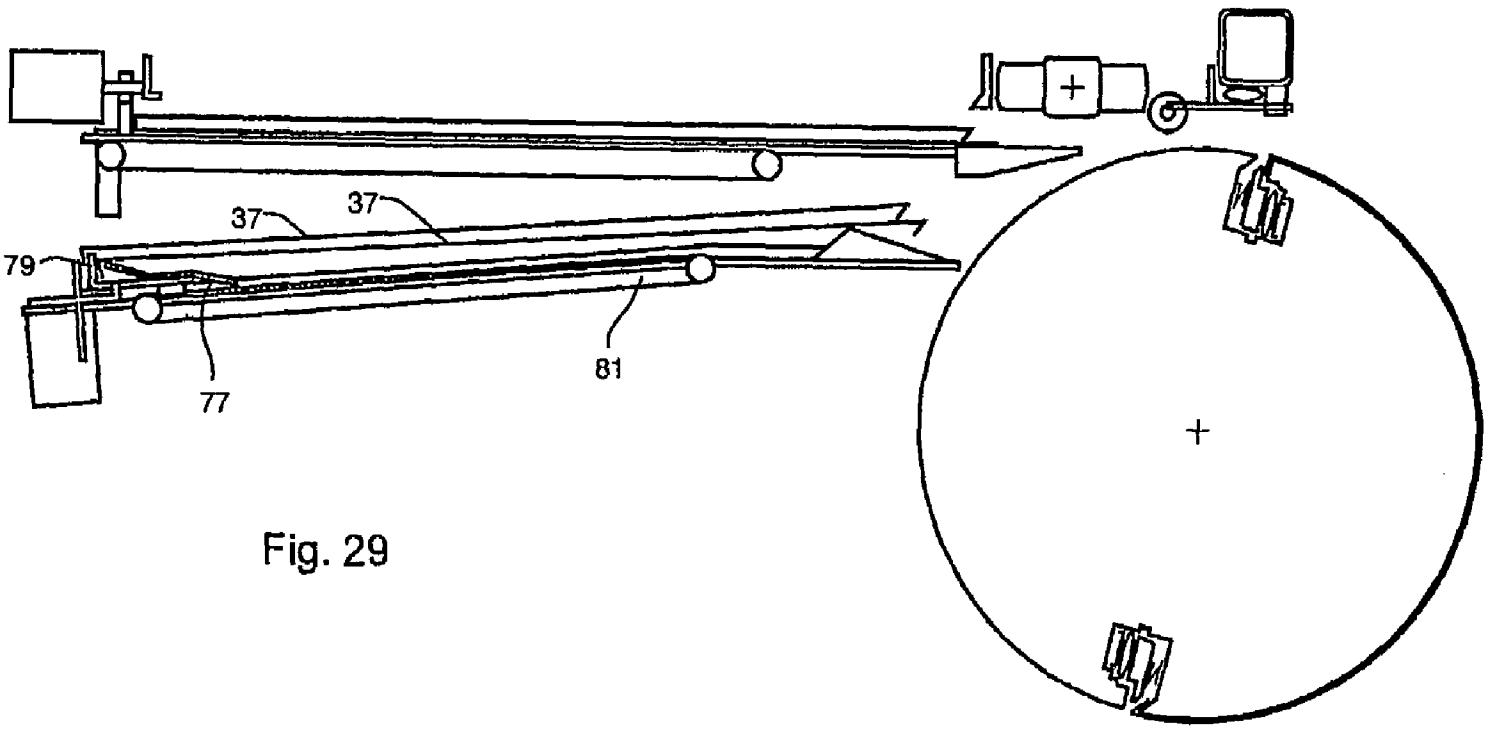

The contact pressure element 24 is now again removed from the forme cylinder 33. Because of the push by the suspension leg 14 of the trailing end 04 against the stop 79, the suspension leg 13 at the leading end 03 of the second used printing forme 37, which is preferably positively connected and suspended at the front edge 16 of the opening 09, is released from the opening 09. Now the leading end 03 of the suspension leg 13 freely rests on the shell 07 of the forme cylinder 33. From the release of the trailing leg 14 at the trailing end 04 until now, the forme cylinder 33 has again performed less than half a revolution. The beveled suspension leg 14 at the trailing end 04 has been hooked between the second ramp 77 and the stop 79. The lifting arm 84 of the printing forme lifting device 82 is lowered, so that the first printing forme 37 resting in the chute 44, the trailing end 04 of which up to now had been held by it, is placed on a strip 89 formed on the stop 79. The strip 89 has a height h89, perpendicular to the support 72, whose value is greater than the length l14 of the beveled suspension leg 14 at the trailing end 04 of the second printing forme 37. The height h89 preferably has a value between the single and double length l14 of the beveled suspension leg 14 at the trailing end 04 of the second printing forme 37 as is shown in FIG. 28.

The conveying device 81, which is connected with the second ramp 77, and the stop 79 now pulls the second printing forme 37 completely into the chute 42, wherein the first and the second printing formes 37 are now arranged on top of each other in the direction of their length L. The conveying device 81, together with the second ramp 77 and the stop 79 for the beveled suspension leg 14 at the trailing end 04 of the printing forme 37 introduced into the chute 42, constitute a moving device which may be seen in FIG. 29.

Figure 30:
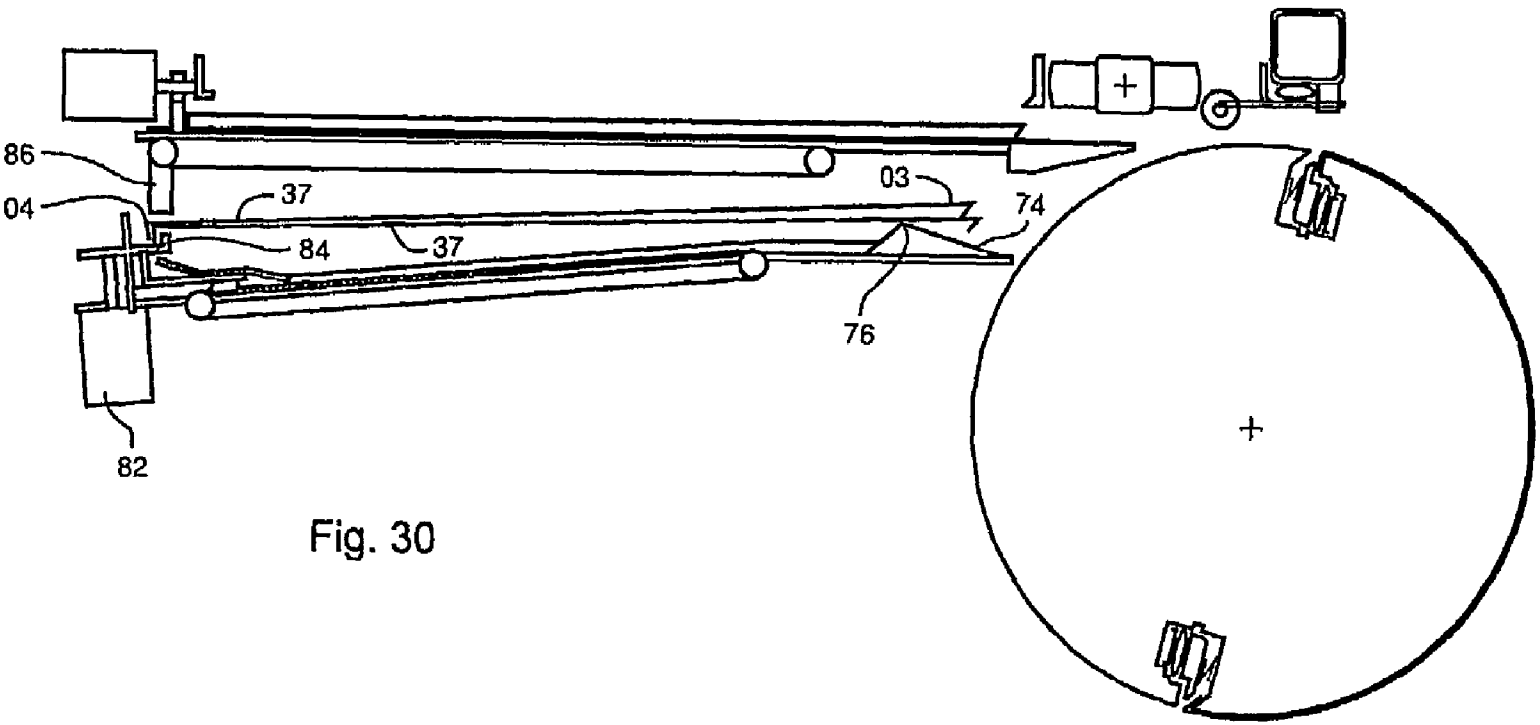

Now, the printing forme lifting device 82 preferably lifts the trailing ends 04 of both used printing formes 37 arranged in the chute 42, by use of its lifting arm 84, up to the securing element 86. The leading end 03 of the second used printing forme 37 rests, with a projection oriented toward the forme cylinder 33, on the high point 76 of the first ramp 74, and the beveled suspension leg 13 at the leading end 03 of the first printing form 37 rests on the leading end 03 of the second printing forme 37 all as seen in FIG. 30.

Figure 31:
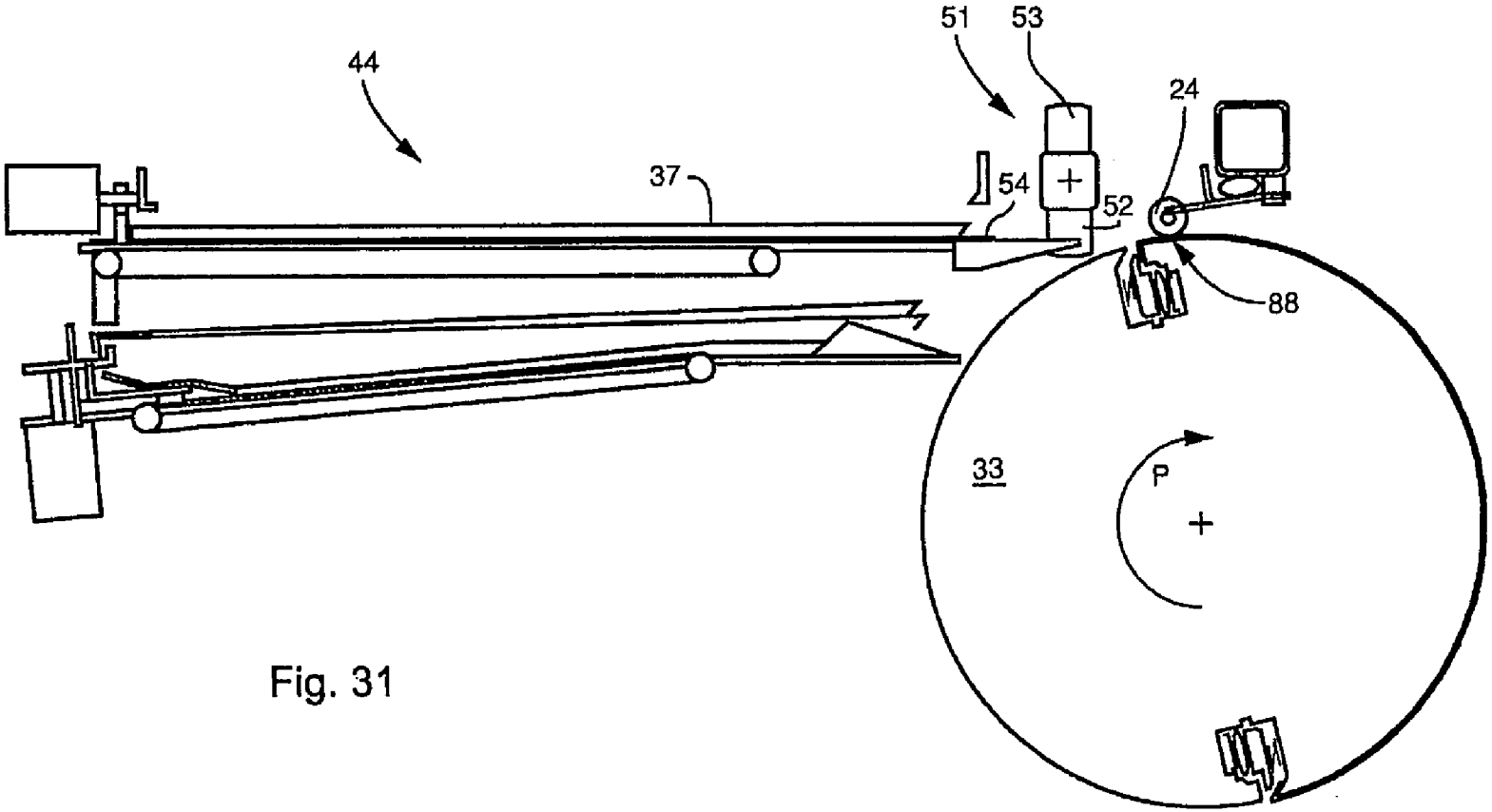
Figure 32:
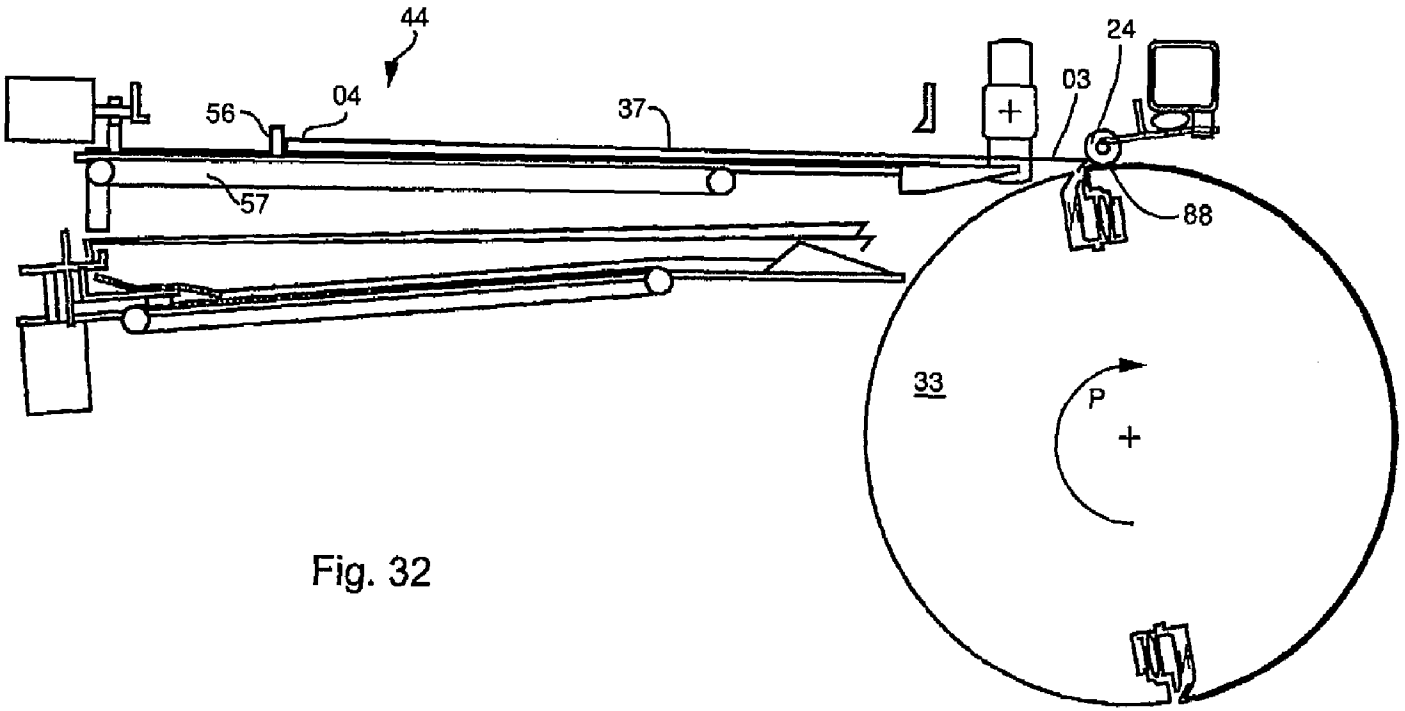

For now mounting the second new printing forme 37, which is lying ready in the upper chute 44, the forme cylinder 33 continues to rotate against the production direction P into the second position, until the opening 09, from which the suspension leg 13 at the leading end 03 of the second printing form 37 which had previously been removed from the forme cylinder 33 had been released, passes the contact point 88 of the contact pressure element 24 placed against the forme cylinder 33. The rear edge 17 of the opening 09 which, in the production direction P of the forme cylinder, is at the rear, is now at a distance a88 from the contact point 88, wherein the distance a88 lies in the range of a few millimeters, and is preferably less than 30 mm, and therefore corresponds to an arc length of less than a one-thirtieth part of the circumference of the forme cylinder 33, as was shown in FIG. 19. Preferably, the contact pressure element 24 is now again placed against the forme cylinder 33 while the opening 09 passes the contact point 88, or after it has passed the contact point 88. The alignment device 51, arranged near the forme cylinder 33, again preferably pivots its diametrical stops 52, 53, which preferably had been horizontally aligned previously, by 90° into a vertical position, so that a stop 52, 53, matched to the width B of the second printing forme 37 to be mounted on the forme cylinder 33, dips into a transport plane, defined by the support 54 in the chute 44 for the second printing forme 37 to be mounted on the forme cylinder 33. The second new printing forme 37 to be mounted on the forme cylinder 33 is now aligned with the forme cylinder 33 at the stop 52, 53 with the correct side registration while being transported out of the chute 44 as depicted in FIG. 31.

The suspension leg 14 on the trailing end 04 of the second new printing forme 37 to be mounted on the cylinder 33 rests against a stop 56, which is connected with a conveying device 57. Corresponding to the method previously explained in connection with FIG. 20, the conveying device 57 is again put into operation, so that the stop 56 conveys the second printing form 37 in a movement which is preferably directed tangentially to the forme cylinder 33, out of the chute 44 until its leading end 03 touches the contact force element 24 placed against the forme cylinder 33. The suspension leg 13, beveled at this leading end 03, now rests between the edge 17 of the opening 09, which is in the rear in the production direction P of the forme cylinder 33, and the contact point 88 of the contact force element 24. This positioning is show in FIG. 32.

Figure 33:
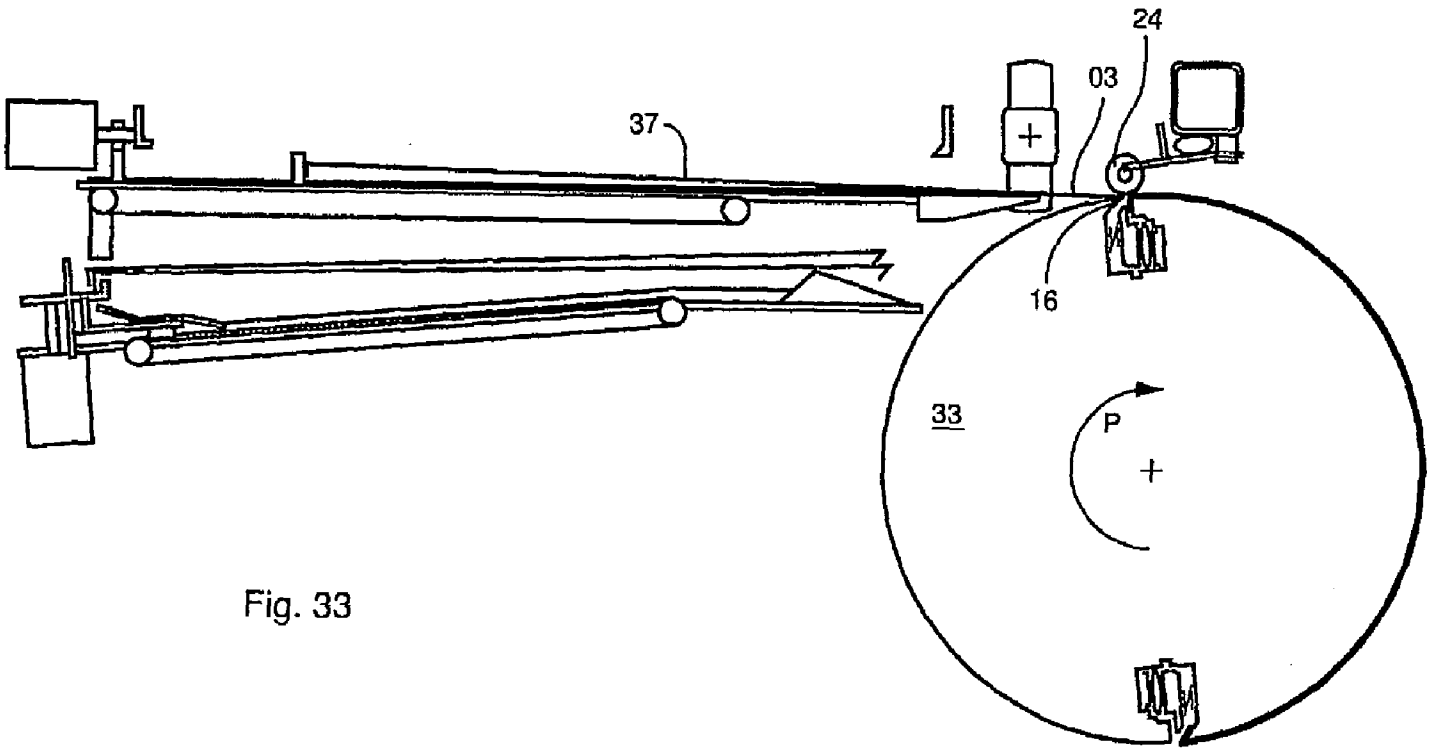
Figure 34:
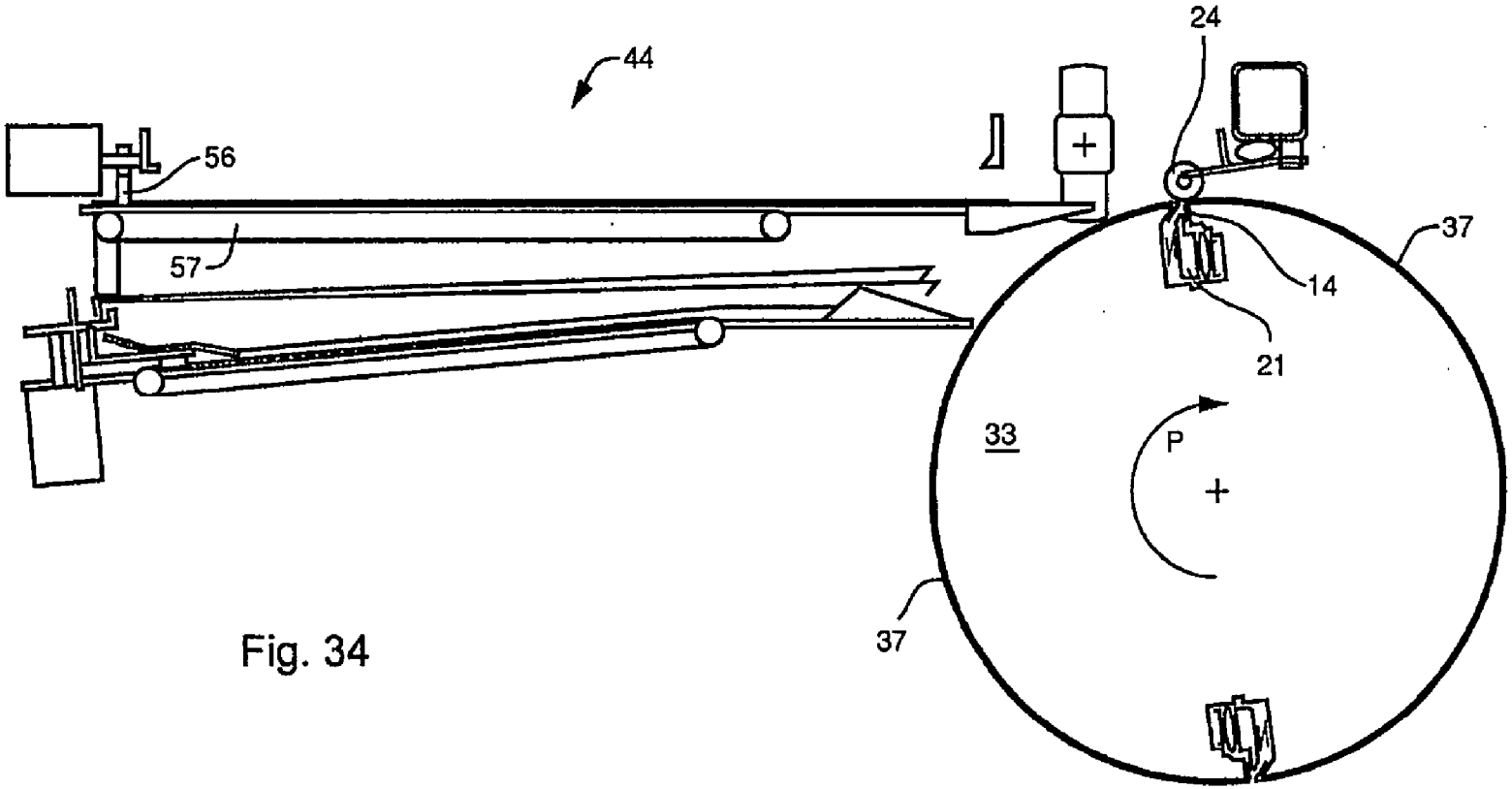

Corresponding to the method previously explained in connection with FIG. 21, the direction of rotation of the forme cylinder 33 is again changed and cylinder 33 begins to rotate in its production direction P. The suspension leg 13 resting on the leading end 03 of the second new printing forme 37 placed on the forme cylinder 33 now slides into the opening 09 and is suspended, preferably positively connected, at the front edge 16 of the opening 09, as shown in FIG. 33.

By continuing the rotation of the forme cylinder 33 in its production direction P, the second new printing forme 37, whose suspension leg 13 is suspended in the opening 09, is completely moved out of the chute 44 and is drawn onto the forme cylinder 33. In the course of the draw-on process, the second new printing forme 37 is rolled onto the forme cylinder 33 by the contact force element 24 placed against the forme cylinder 33. After half a revolution of the forme cylinder 33 in its production direction P, the contact force element 24 now pushes the beveled suspension leg 14 at the trailing end 04 of the second printing forme 37 into the opening 09. The holding element 21 in the groove 08 assigned to this opening 09 was previously released and is now brought into the operating position in which it fixes the suspension leg 14 at the trailing end 04 of the second printing forme 37 introduced into the opening 09 in place, for example by clamping. The conveying device 57 moves the stop 56, which is connected with it, back into its end position on the side of the upper chute 44 facing away from the forme cylinder. The upper chute 44 is now empty, while two used printing formes 37 have now been placed into the lower chute 42, as may be seen in FIG. 34.

Figure 35:
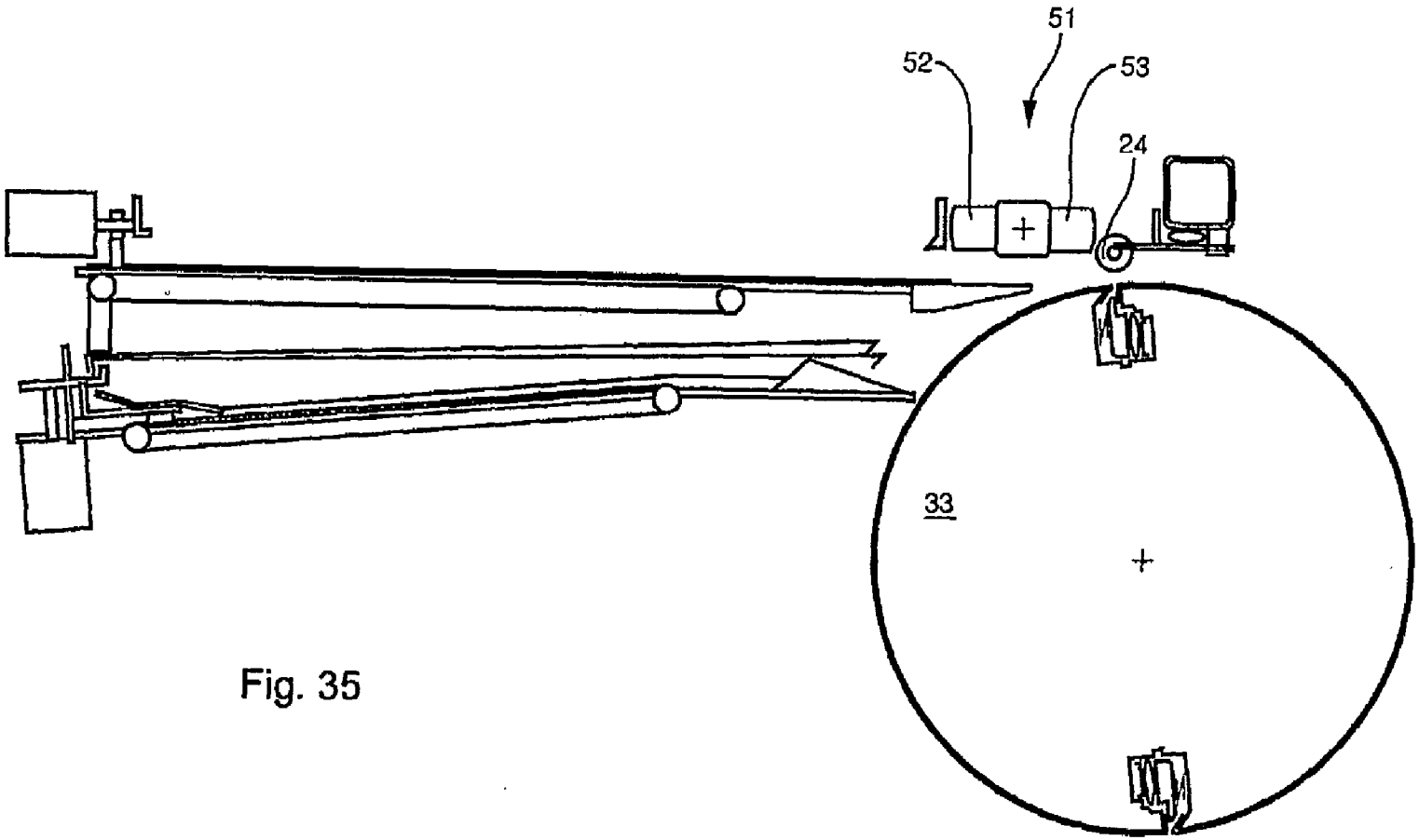

The contact pressure element 24 is now moved away from the forme cylinder 33, and the diametrical stops 52, 53 of the alignment device 51 are preferably again pivoted into a horizontal position. The change of a second printing forme 37 on the forme cylinder 33 is finished with the method steps described. A used second printing forme 37 was first removed and a fresh second printing forme 37 was attached. The forme cylinder 33 is again ready for production. This change can also be completely performed by the subject device in less than one minute. The change of a first and of a second printing forme 37 can therefore be terminated in less than two minutes, and preferably can be terminated altogether in less than ninety seconds as shown in FIG. 35.

While preferred embodiments of devices for storing a dressing to be supplied to the cylinder of a printing machine, in accordance with the present invention, have been set forth fully and completely hereinabove, it will be apparent to one of skill in the art that various changes in, for example, the drives for the cylinders, the source of pneumatic pressure and the like could be made without departing from the true spirit and scope of the present invention which is accordingly to be limited only by the following claims.

What is claimed is:

1. A device for storing dressings to be applied to a cylinder of a rotary printing press comprising:

means supporting a plurality of dressings to be applied side-by-side to the cylinder in a cylinder axial direction, said dressings being stored side-by-side;

at least first and second levels in said dressing supporting means, said at least first and second levels being arranged side by side and vertically offset with respect to each other and constituting a first storage position for said plurality of dressings; and the device further comprising a second storage position adapted to receive said plurality of dressings from said first storage position and to store said plurality of dressings side-by-side on a single level, said single level extending in said cylinder axial direction.

2. The device of claim 1 wherein said at least first and second levels are alternatingly vertically offset with respect to each other.

3. The device of claim 1 wherein said at least first and second levels which are arranged side-by-side and vertically offset are alternatingly arranged in said cylinder axial direction.

4. The device of claim 1 further including a support extending in said cylinder axial direction, said at least first and second levels being arranged vertically above said support.

5. The device of claim 4 wherein said support constitutes said second storage position.

6. The device of claim 4 wherein the dressings which are deposited on said at least first and second levels, which are vertically offset in respect to each other, are deposited side-by-side in said cylinder axial direction.

7. The device of claim 4 wherein said at least first and second levels which are arranged side-by-side and vertically offset are arranged in a common chute.

8. The device of claim 4 wherein said dressings arranged side-by-side with respect to each other can be deposited on said support.

9. The device of claim 4 wherein one of said dressings deposited on said support is oriented horizontally.

10. The device of claim 1 further including a conveying device adapted to feed one of said dressing stored in said second storage position to the cylinder.

11. The device of claim 10 wherein said conveying device feeds a plurality of dressings simultaneously to said cylinder from said second storage position.

12. The device of claim 10 wherein said conveying device feeds said dressing to said cylinder in a linear movement.

13. The device of claim 10 further including a support extending in said cylinder axial direction beneath said at least first and second levels and wherein said conveying device feeds one of said dressings deposited on said support to said cylinder parallel with said support.

14. The device of claim 1 further including a stop adapted to engage a side of one of said dressings and wherein dressings reach said second storage position by sliding along said stop.

15. The device of claim 14 wherein said sliding movement is directed vertically downward.

16. The device of claim 1 further including a dressing side holding element adapted to hold at least one side of one of said dressings stored on one of said at least first and second levels arranged side by side and vertically offset.

17. The device of claim 16 further including means adapted to move said holding element along an actuating path.

18. The device of claim 17 wherein movement of said holding element along said actuating path releases said dressing stored on one of said at least first and second levels from said holding element.

19. The device of claim 16 further including at least one stop, said one dressing, upon being released from said dressing side holding element, contacting said stop with a dressing side.

20. The device of claim 16 wherein said holding element is a guide rail.

21. The device of claim 20 wherein said vertical offset of said at least first and second levels is a whole number multiple of a structural height of said guide rail.

22. The device of claim 1 further including at least one stop extending perpendicular to a dressing support surface.

23. The device of claim 22 wherein said at least one stop is rigid.

24. The device of claim 22 wherein two adjacent dressings contact opposite sides of said stop.

25. The device of claim 1 wherein said dressings arranged side-by-side are spaced at a dressing spacing distance in said device, said dressing spacing distance corresponding to an axial spacing distance between said dressings on the cylinder.

26. The device of claim 1 wherein said dressings stored on said at least first and second levels arranged side-by-side and vertically offset are arranged horizontally.

27. The device of claim 1 wherein up to six dressings are arranged side by side in said cylinder axial direction in said dress supporting means.

* * * * *